US006706981B1

(12) United States Patent
Ma et al.

(10) Patent No.: US 6,706,981 B1
(45) Date of Patent: Mar. 16, 2004

(54) TECHNIQUES TO FABRICATE A RELIABLE OPPOSING CONTACT STRUCTURE

(75) Inventors: Qing Ma, San Jose, CA (US); Kramadhati V. Ravi, Atherton, CA (US); Valluri Rao, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/389,725

(22) Filed: Mar. 13, 2003

Related U.S. Application Data

(62) Division of application No. 10/231,565, filed on Aug. 29, 2002, now Pat. No. 6,621,022.

(51) Int. Cl.[7] ..... H01H 57/00

(52) U.S. Cl. ..... 200/181; 200/267

(58) Field of Search ..... 200/262–270, 200/181; 29/592, 622

(56) References Cited

U.S. PATENT DOCUMENTS 4,959,515 A * 9/1990 Zavracky et al. ..... 200/181
5,677,823 A * 10/1997 Smith ..... 361/234
6,054,659 A * 4/2000 Lee et al. ..... 200/181
6,621,022 B1 * 9/2003 Ma et al. ..... 200/267

* cited by examiner

*Primary Examiner*—Michael Friedhofer
*Assistant Examiner*—Lisa Klaus
(74) *Attorney, Agent, or Firm*—Glen B. Choi

(57) ABSTRACT

A switch structure having multiple contact surfaces that may contact each other. One or more of the contact surfaces may be coated with a resilient material such as diamond.

31 Claims, 27 Drawing Sheets

TECHNIQUES TO FABRICATE A RELIABLE OPPOSING CONTACT STRUCTURE

This application is a division of Ser. No. 10/231,565 filed Aug. 29, 2002 now U.S. Pat. No. 6,621,022.

FIELD

The subject matter herein generally relates to the field of switches.

DESCRIPTION OF RELATED ART

Radio frequency switches perform numerous switching cycles over their lifetime. Some radio frequency switches may operate, in part, by contact between two metal contacts. Over time, the surface(s) of the contacts may wear down. Wear may subject the switch to stiction, whereby contacts of the switch adhere to one another during contact. Stiction may slow the rate at which switch operations may be performed.

BRIEF DESCRIPTION OF THE DRAWINGS

Note that use of the same reference numbers in different figures indicates the same or like elements.

DETAILED DESCRIPTION

FIG. 1

Figure 1:
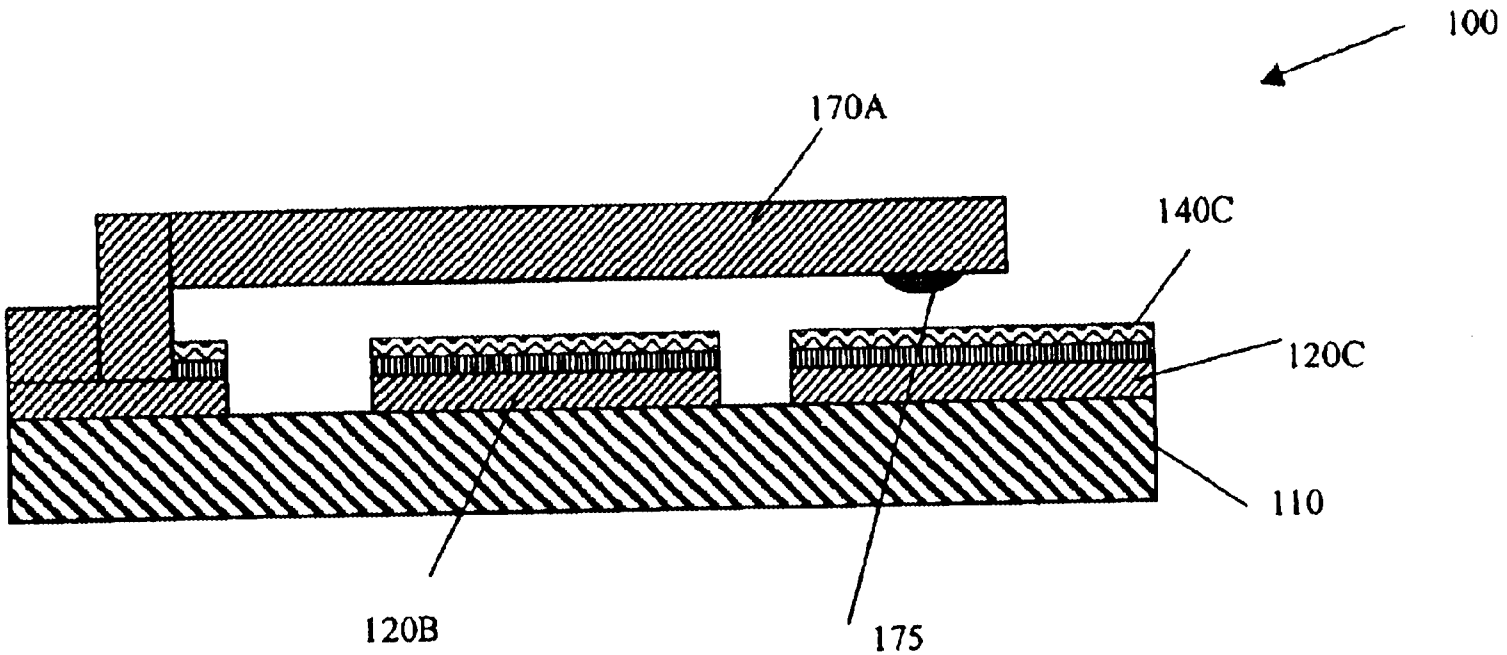
FIG. 1 depicts in cross section a switch, in accordance with an embodiment of the present invention

FIG. 1 depicts in cross section a switch 100, in accordance with an embodiment of the present invention. Switch 100 may include base 110, arm 170A, contact 175, second contact 120C, and actuation 120B. Base 110 may support second contact 120C and arm 170A. When a voltage is applied between actuation 120B and arm 170A, arm 170A may lower contact 175 to contact with second contact 120C. In accordance with an embodiment of the present invention, second contact 120C may have a durable protective coating layer 140C that may protect second contact 120C from wear.

Figure 2:
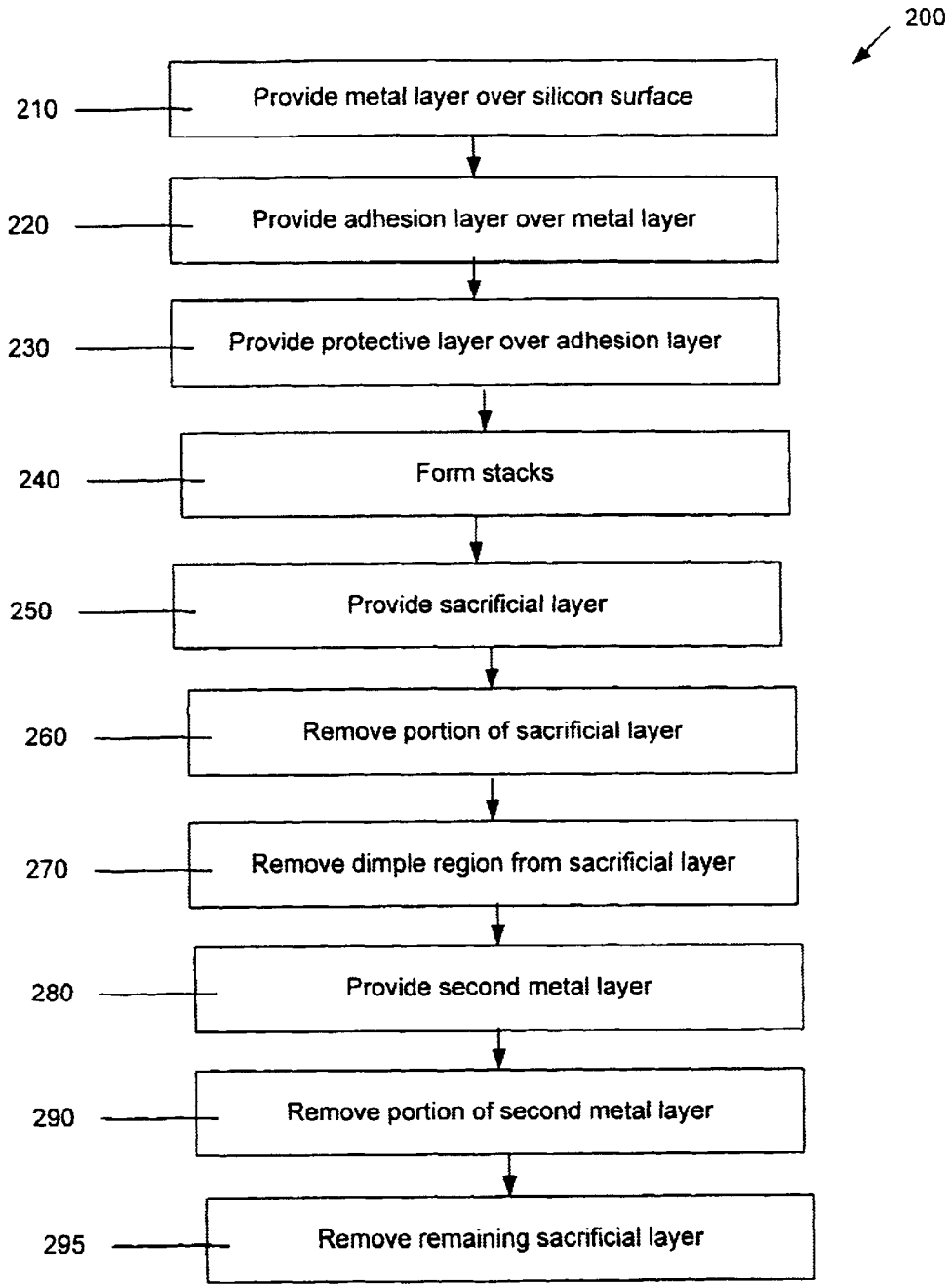
FIG. 2 depicts one possible process that may be used to construct the switch of FIG. 1, in accordance with an embodiment of the present invention.
Figure 3:
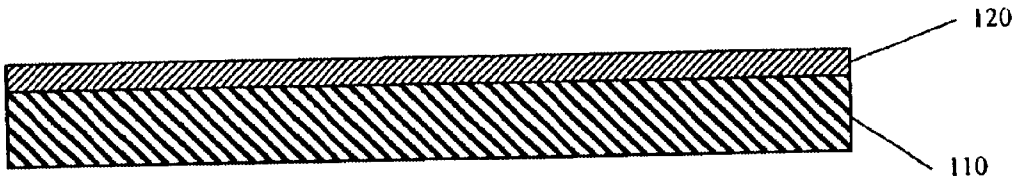
FIGS. 3 to 11 depict in cross section various stages of fabrication of the switch of FIG. 1, in accordance with an embodiment of the present invention.

In accordance with an embodiment of the present invention, FIG. 2 depicts one possible process that may be used to construct the switch 100 depicted in FIG. 1. Action 210 includes providing metal layer 120 over silicon surface 110. FIG. 3 depicts in cross section an example structure that may result from action 210. A suitable implementation of silicon surface 110 is a silicon wafer. Suitable materials of layer 120 include gold and/or aluminum. A suitable technique to provide metal layer 120 includes sputter deposition or physical vapor deposition. A suitable thickness of layer 120 is approximately ½ to 1 micron.

Figure 4:
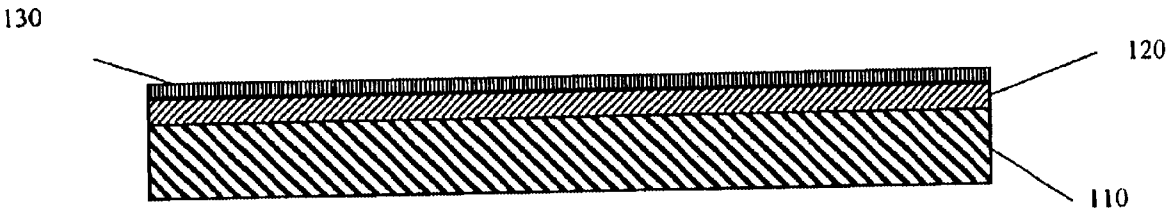

Action 220 includes providing adhesion layer 130 over metal layer 120. FIG. 4 depicts in cross section an example structure that may result from action 220. Suitable materials of layer 130 include titanium, molybdenum, and tungsten. A suitable technique to provide layer 130 includes sputter deposition and physical vapor deposition. A suitable thickness of layer 130 is approximately 0.1 micron.

Figure 5:
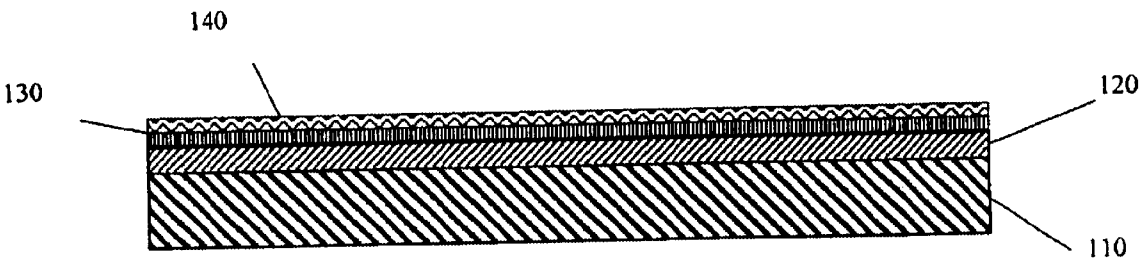

Action 230 includes providing protective layer 140 over layer 130. FIG. 5 depicts in cross section an example structure that may result from action 230. Suitable materials of protective layer 140 include, but are not limited to, diamond, rhodium, ruthenium and/or diamond-like carbon film. A suitable technique to provide protective layer 140 includes plasma enhanced chemical vapor deposition (CVD). A suitable thickness of layer 140 is approximately 100 to 500 angstroms.

Figure 6:
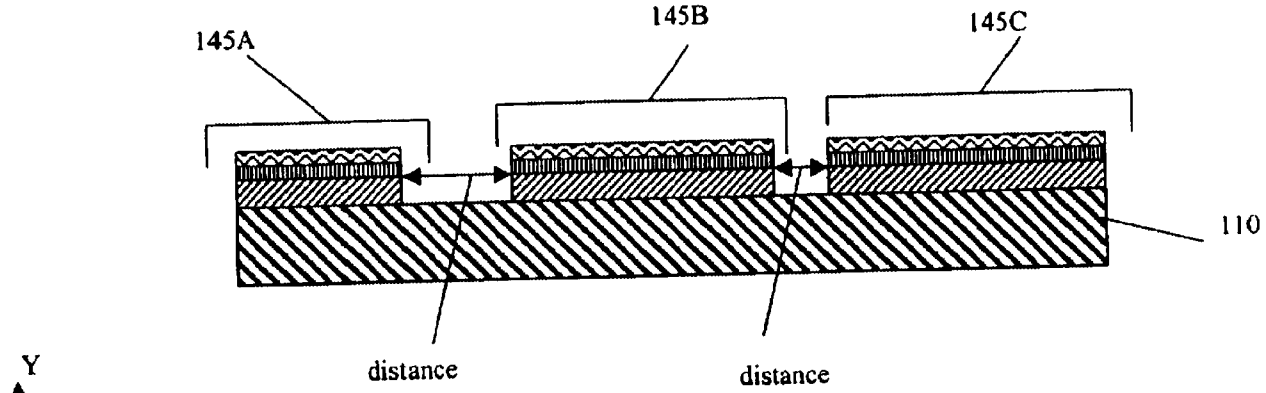

Action 240 includes removing portions of layers 120 to 140 to form stacks 145A, 145B, and 145C. Each of stacks 145A, 145B, and 145C includes portions of layers 120 to 140. FIG. 6 depicts in cross section an example structure that may result from action 240. A suitable distance between stacks 145A and 145B (along the X axis) is approximately 5 to 50 microns. Layer 120B of stack 145B maybe referred to as actuation 120B. A suitable distance between stacks 145B and 145C (along the X axis) is approximately 1 to 10 microns. In action 240, a suitable technique to remove portions of layers 120 to 140 includes: (1) applying a mask to portions of the exposed surface of layer 140 that are not to be removed; (2) photolithography to polymerize the mask (thereby forming a polymerized resist); (3) to remove portions of layer 140, etch layer 140 by reactive ion etching or oxygen plasma; (4) to remove layers 120 and 130, using fluorinated hydrocarbons (e.g., $CF_4$ or $C_2F_6$), or a combination of nitric acid with sulfuric acid; and (5) removing polymerized resist by using a resist stripper solvent.

Figure 7:
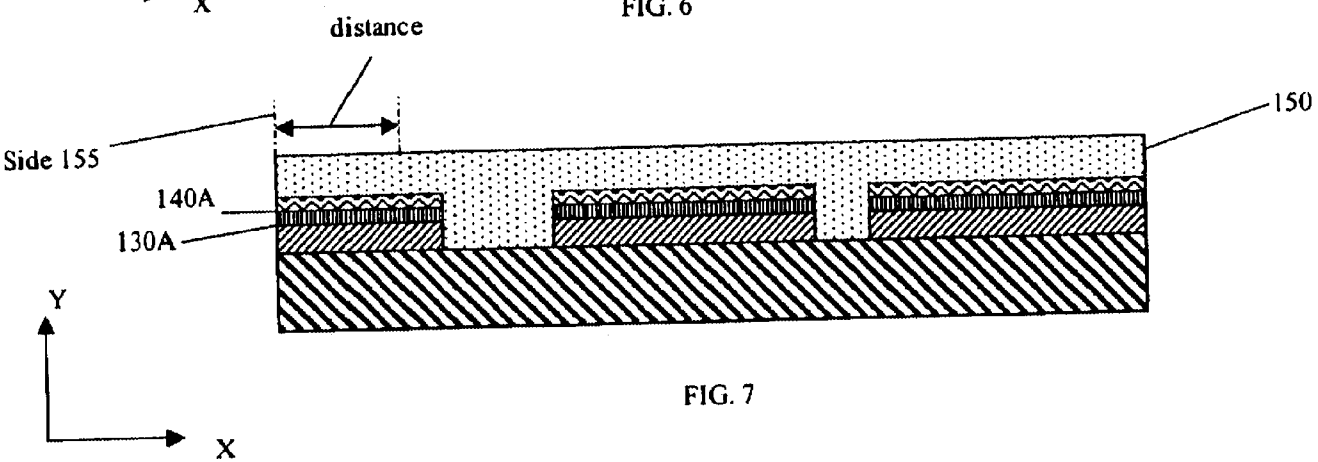

Action 250 includes providing sacrificial layer 150 over the structure depicted in cross section in FIG. 6. FIG. 7 depicts in cross section an example structure that may result from action 250. Suitable materials of layer 150 include $SiO_2$, polymer, glass-based materials, and metals (e.g., cop). Suitable techniques to provide layer 150 include (1) sputtering, chemical vapor deposition (CVD), spin coating, or physical vapor deposition followed by (2) polishing a surface of layer 150 using e.g., chemical mechanical polish (CMP). A suitable thickness of layer 150 is approximately 1 micron.

Figure 8:
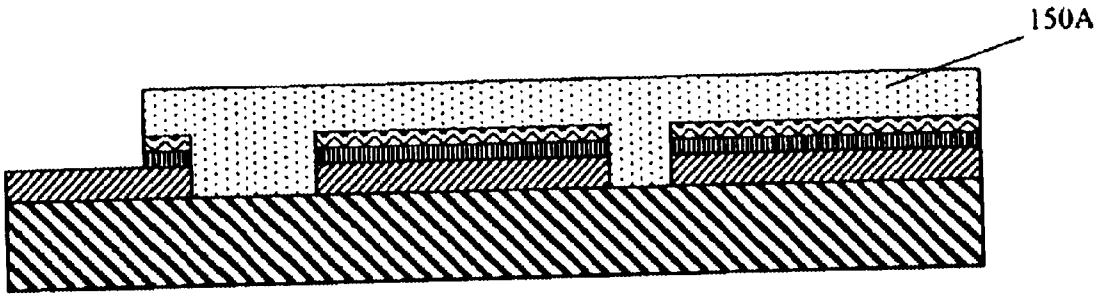

Action 260 includes removing a portion of layer 150 and portions of layers 130A and 140A (portions of respective laws 130 and 140 among stack 145A) of stack 145A from the structure depicted in FIG. 7. FIG. 8 depicts in cross section an example structure that may result from action 260. From side 155 of structure depicted in FIG. 7, a suitable distance is 10 to 30 microns along the X axis to remove portion of layer 150 and portions of layers 130A and 140A of stack 145A. A suitable technique to implement action 260 includes: (1) applying a mask to portions of the exposed surface of layer 150 that are not to be removed; (2) photolithography to polymerize the mask (thereby forming a polymerized resist); (3) to remove layer 150, providing an HF solution; (4) to remove layer 140A, etch layer 140A by reactive ion etching or oxygen plasma; (5) to remove layer 130A, providing fluorinated hydrocarbons (e.g., CF4, C2F6), or a combination of nitric acid with sulfuric acid; and (6) removing polymerized resist by using a resist stripper solvent. Hereafter, re-shaped layer 150 is referred to as layer 150A.

Figure 9:
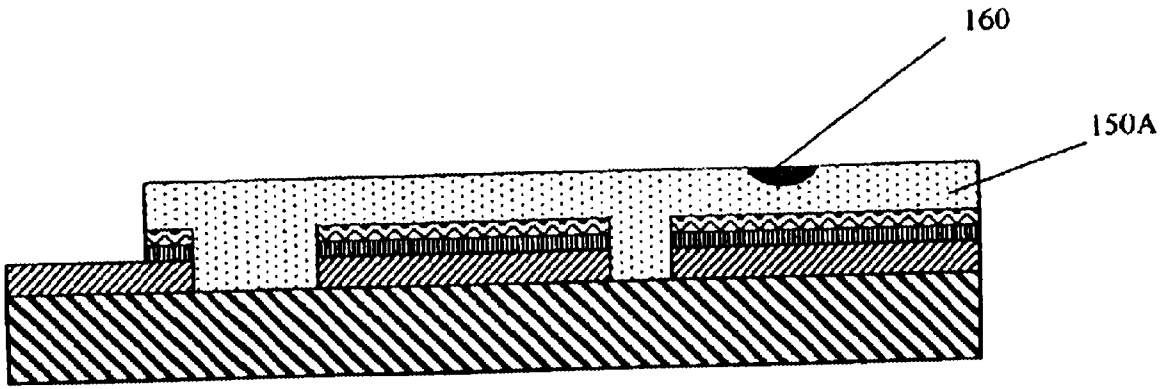

Action 270 includes removing dimple region 160 from layer 150A. FIG. 9 depicts in cross section an example structure that may result from action 270. Dimple region 160 may be dome shaped. A suitable technique to implement action 270 includes: (1) providing a mask over portions of the exposed surface of layer 150A that are not to be removed; (2) photolithography to polymerize the mask (thereby forming a polymerized resist); (3) to remove a dimple region of layer 150A, etch layer 150A by reactive ion etching to a depth of approximately ½ micron; and (4) removing polymerized resist by using a resist stripper solvent.

Figure 10:
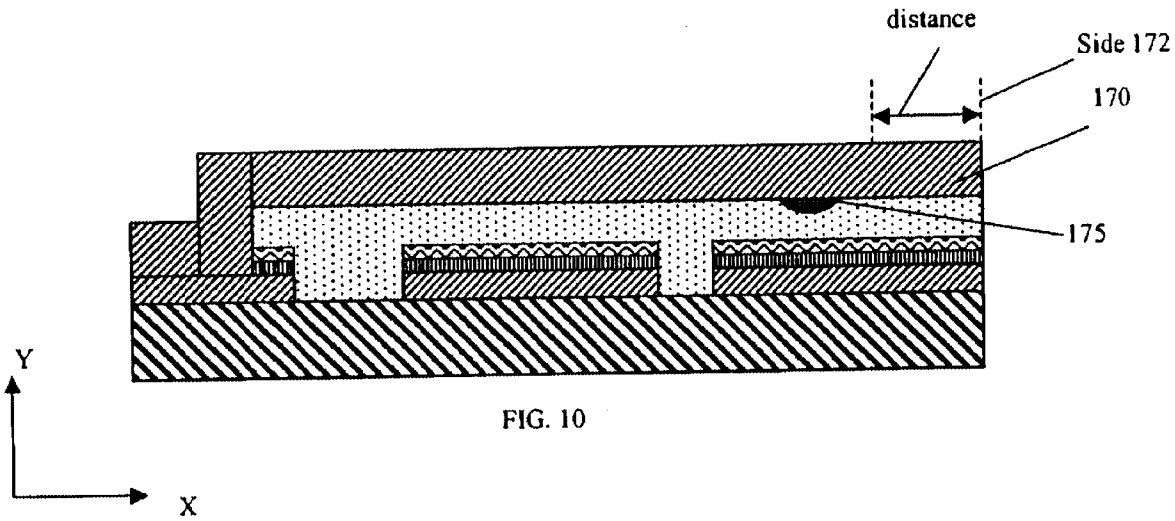

Action 280 includes providing metal conductive layer 170 in dimple region 160 and over the structure shown in FIG. 9. FIG. 10 depicts in cross section an example structure that may result from action 280. A suitable material of metal conductive layer 170 includes gold and/or aluminum. Layer 170 may be the same material but does not have to be the same material as that of metal layer 120. A suitable technique to provide layer 170 includes sputter deposition or physical vapor deposition. A suitable thickness of layer 170 is 2 to 4 microns. Dimple contact 175 may thereby be formed from the portion of metal conductive layer 170 that fills dimple region 160.

Figure 11:
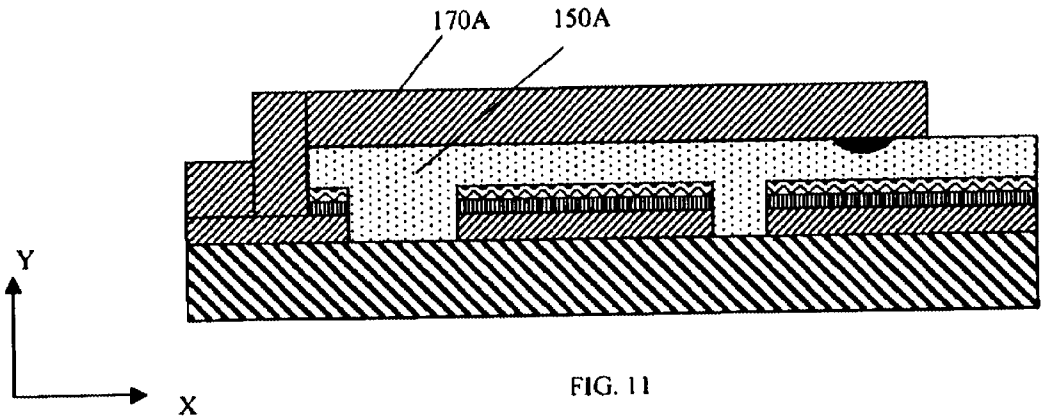

Action 290 includes removing a portion of layer 170 up to a distance of approximately 2 to 8 microns (along the X axis) from side 172 of the structure depicted in FIG. 10. FIG. 11 depicts in cross section an example structure that may result from action 290. A suitable technique to remove a portion of layer 170 includes: (1) applying a mask to portions of the exposed surface of layer 170 that are not to be removed; (2) photolithography to polymerize the mask (thereby forming a polymerized resist); (3) using fluorinated hydrocarbons (e.g., $CF_4$ or $C_2F_6$), or a combination of nitric acid with sulfuric acid; and (4) removing polymerized resist by using a resist stripper solvent. Hereafter the re-shaped layer 170 is hereafter referred to as layer or arm 170A.

Action 295 includes removing a remaining sacrificial layer 150A. FIG. 1 depicts in cross section an example structure that may result from action 295. A suitable technique to remove remaining sacrificial layer 150A includes submerging the structure depicted in FIG. 11 into an HF solution.

FIG. 12

Figure 12:
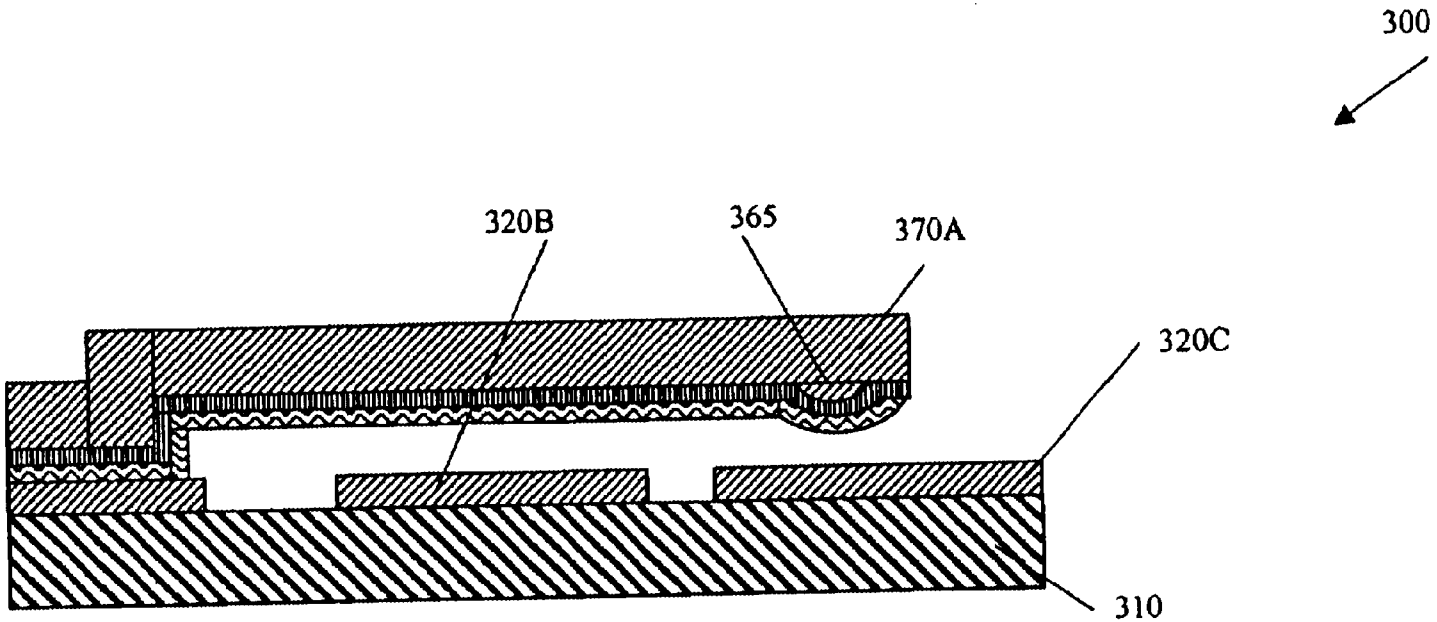
FIG. 12 depicts in cross section a switch, in accordance with an embodiment of the present invention.

FIG. 12 depicts in cross section a switch 300, in accordance with an embodiment of the present invention. Switch 300 may include base 310, arm 370A, actuation 320B, first contact 365, and second contact 320C. When an electric field is applied between actuation 320B and arm 370A, then contact 365 may lower to contact second contact 320C. In accordance with an embodiment of the present invention, first contact 365 may have a durable coating layer that may protect first contact 365 from wear.

Figure 13:
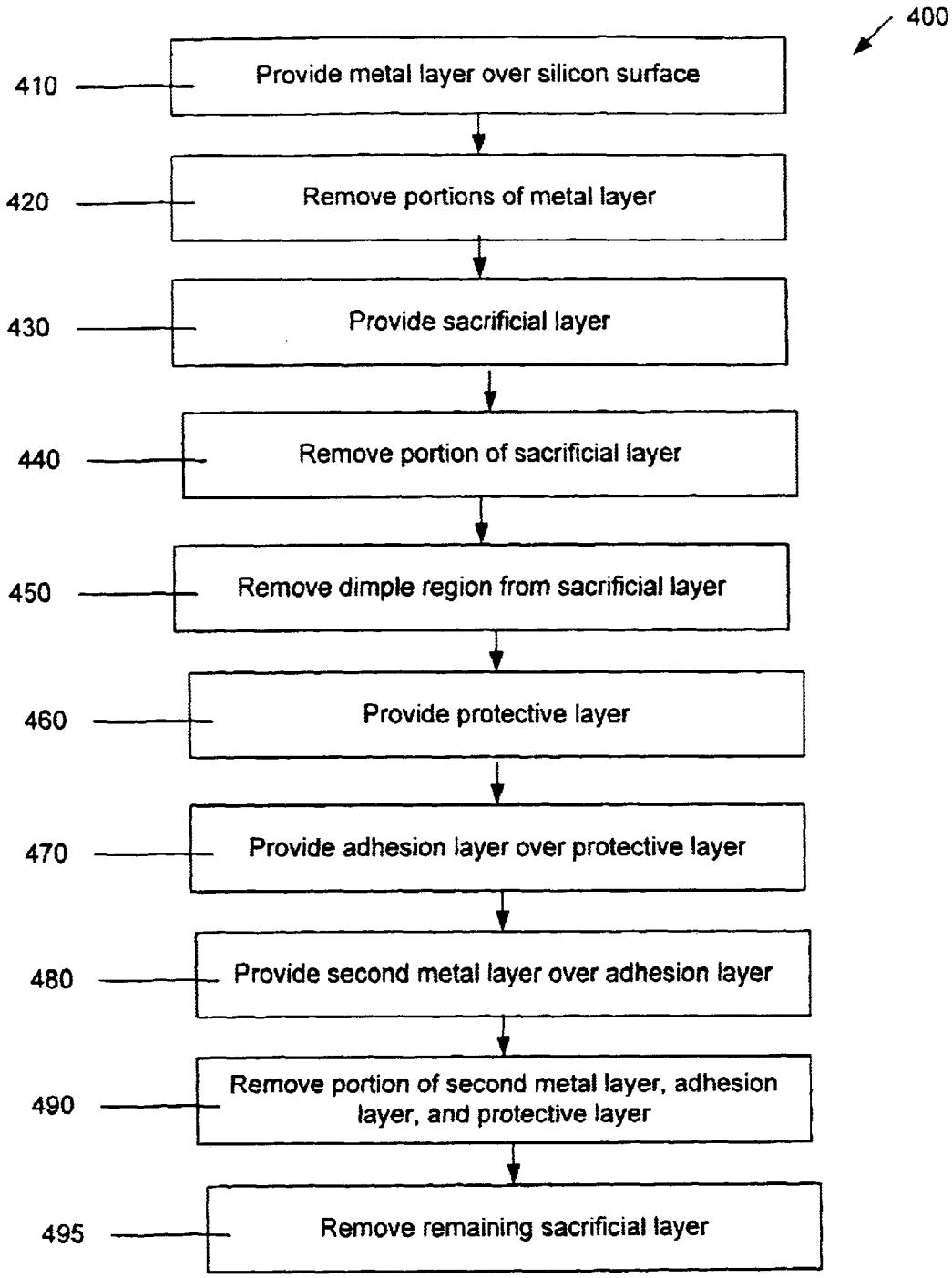
FIG. 13 depicts one possible process that may be used to construct the switch of FIG. 12, in accordance with an embodiment of the present invention.
Figure 14:
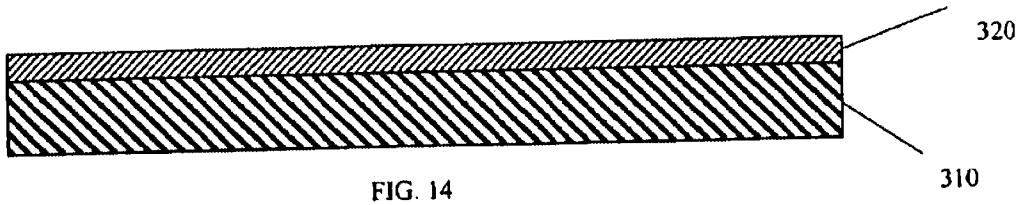
FIGS. 14 to 22 depict in cross section various stages of fabrication of the switch of FIG. 12, in accordance with an embodiment of the present invention.

In accordance with an embodiment of the present invention, FIG. 13 depicts one possible process that may be used to construct the switch 300 depicted in FIG. 12. Action 410 includes providing metal layer 320 over silicon surface 310. FIG. 14 depicts in cross section an example structure that may result from action 410. A suitable implementation of silicon surface 310 is a silicon wafer. Suitable materials of layer 320 include gold and/or aluminum. A suitable technique to provide metal layer 320 includes sputter deposition or physical vapor deposition. A suitable thickness of layer 320 is approximately ½ to 1 micron.

Figure 15:
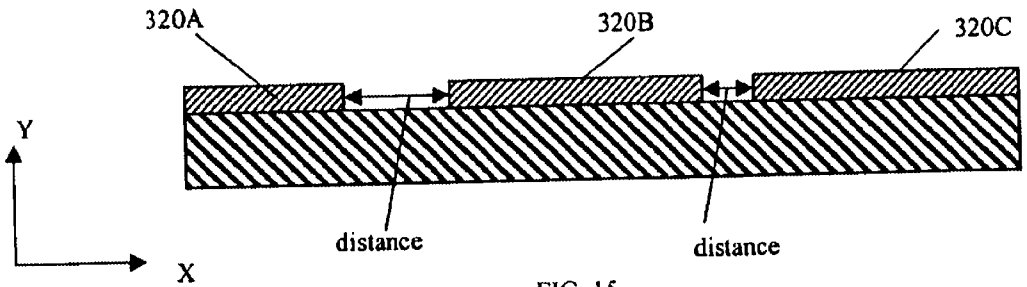

Action 420 includes removing portions of layer 320 to form layers 320A, 320B and 320C. FIG. 15 depicts in cross section an example structure that may result from action 420. A suitable distance between layers 320A and 320B (along the X axis) is approximately 5 to 50 microns. A suitable distance between layers 320B and 320C (along the X axis) is approximately 1 to 10 microns. A suitable technique to remove portions of layer 320 includes: (1) applying a mask to portions of the exposed surface of layer 320 that are not to be removed; (2) photolithography to polymerize the mask (thereby forming a polymerized resist); (3) applying fluorinated hydrocarbons (e.g., $CF_4$ or $C_2F_6$), or a combination of nitric acid with sulfuric acid; and (4) removing polymerized resist by using a resist stripper solvent. Herein, layer 320B may otherwise by referred to as actuation 320B whereas layer 320C may otherwise be referred to as second contact 320C.

Figure 16:
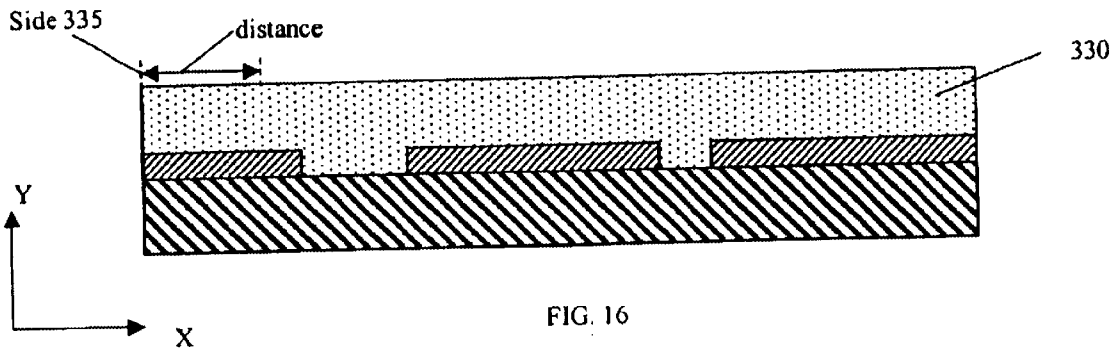

Action 430 includes providing a sacrificial layer 330 over the structure depicted in cross section in FIG. 15. FIG. 16 depicts in cross section an example structure that may result from action 430. Suitable materials of layer 330 include $SiO_2$, polymer, glass-based materials, and/or metals (e.g., copper). Suitable techniques to provide layer 330 include (1) sputtering, chemical vapor deposition (CVD), or physical vapor deposition followed by (2) polishing a surface of layer 330 using e.g., chemical mechanical polishing (CMP). Suitable thickness of layer 330 over layers 320A, 320B and 320C (along the Y axis) is approximately 1 micron.

Figure 17:
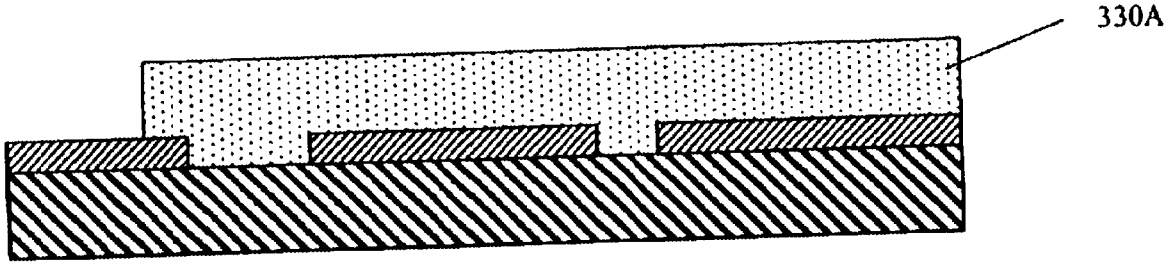

Action 440 includes forming an anchor region in sacrificial layer 330. FIG. 17 depicts in cross section an example structure that may result from action 440. From side 335 of the structure depicted in cross section in FIG. 16, a suitable distance along the X axis to remove portion of layer 330 is 10 to 30 microns. A suitable technique to implement action 440 includes: (1) applying a mask to portions of the exposed surface of layer 330 that are not to be removed; (2) photolithography to polymerize the mask (thereby forming a polymerized resist); (3) to remove layer 330, providing an HF solution; and (4) removing polymerized resist by using a resist stripper solvent. Hereafter, reshaped layer 330 may be referred to as layer 330A.

Figure 18:
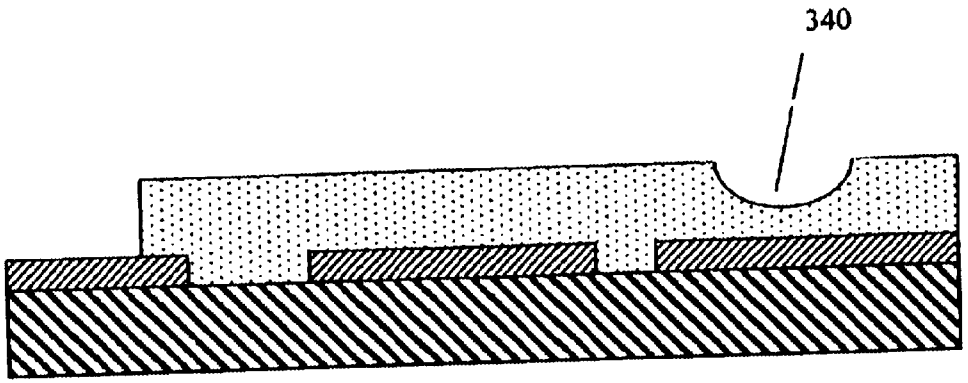

Action 450 includes removing dimple region 340 from layer 330A. FIG. 18 depicts in cross section an example structure that may result from action 450. Dimple region 340 may be dome shaped. A suitable technique to implement action 450 includes: (1) providing a mask over portions of the exposed surface of layer 330A that are not to be removed; (2) photolithography to polymerize the mask (thereby forming a polymerized resist); (3) to remove a dimple region from layer 330A, etch layer 330A by reactive ion etching to a depth of approximately ½ micron; and (4) removing polymerized resist by using a resist stripper solvent.

Figure 19:
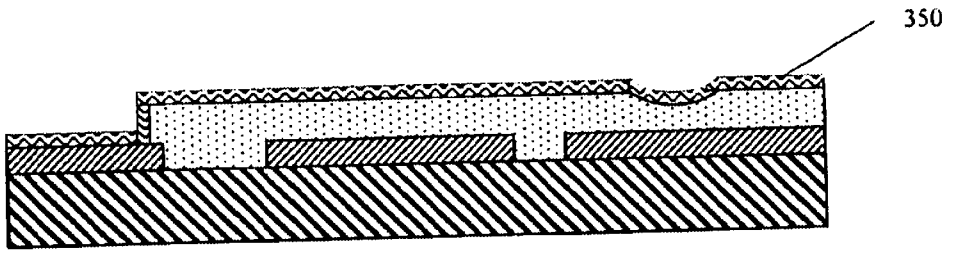

Action 460 includes providing protective layer 350 over structure depicted in FIG. 18. FIG. 19 depicts in cross section an example structure that may result from action 460. Suitable materials of protective layer 350 include, but are not limited to, diamond, rhodium, ruthenium, and/or diamond-like carbon film. A suitable technique to provide protective layer 350 includes plasma enhanced chemical vapor deposition (CVD). Suitable thickness of layer 350 is approximately 100 to 500 angstroms.

Figure 20:
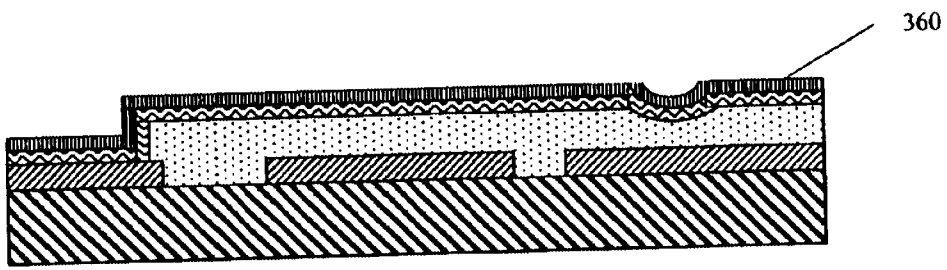

Action 470 includes providing adhesion layer 360 over the structure depicted in cross section in FIG. 19. FIG. 20 depicts in cross section an example structure that may result from action 470. Suitable materials of layer 360 include titanium, molybdenum, and/or tungsten. A suitable technique to provide metal layer 360 includes sputter deposition or physical vapor deposition. A suitable thickness of layer 360 is approximately 0.1 micron.

Figure 21:
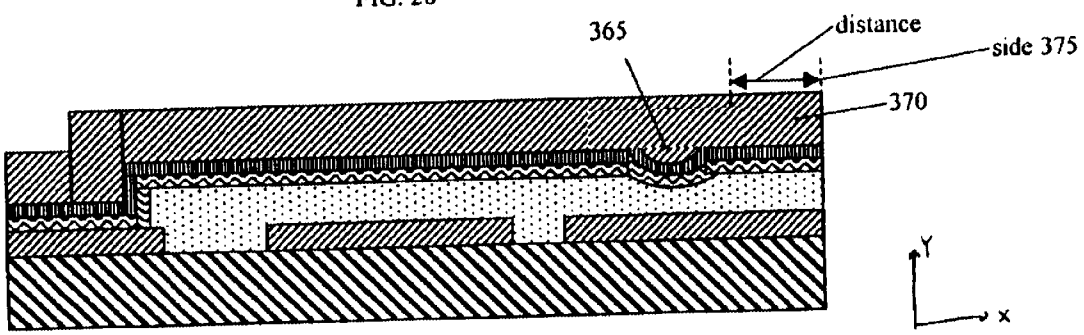

Action 480 includes providing a second metal conductive layer 370 over the structure depicted in cross section in FIG. 20. FIG. 21 depicts in cross section an example structure that may result from action 480. A suitable material of the second metal conductive layer 370 includes gold and aluminum. A suitable techniques to provide layer 370 include sputter deposition and physical vapor deposition. A suitable thickness of layer 370 is approximately 2 to 4 microns. Herein, a portion of dimple region 340 filled with second metal conductive layer 370 is otherwise referred to as first contact 365.

Figure 22:
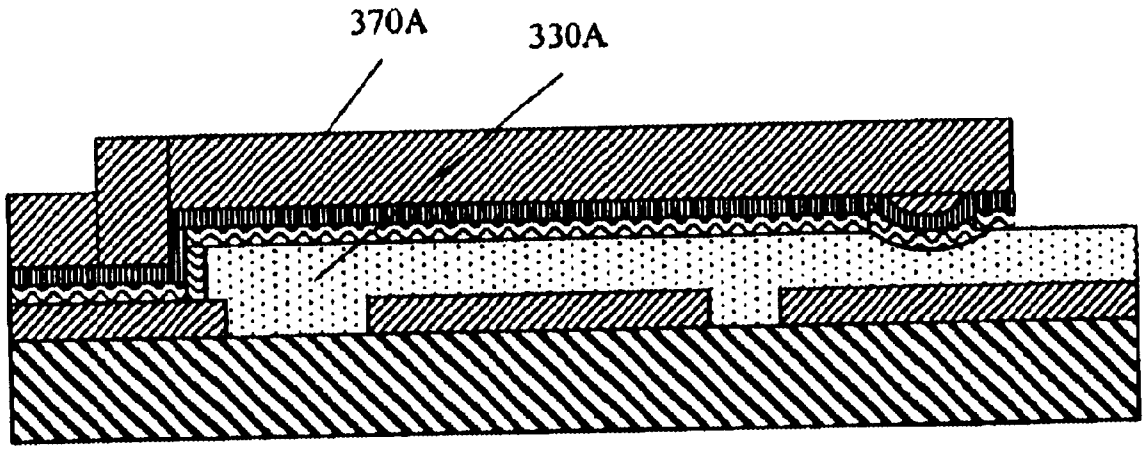

Action 490 includes removing a portion of layer 370 up to a distance of approximately 2 to 8 microns (along the X axis) from side 375. FIG. 22 depicts in cross section an example structure that may result from action 490. A suitable technique to remove portions of layer 370 includes: (1) applying a mask to portions of the exposed surface of layer 370 that are not to be removed; (2) photolithography to polymerize the mask (thereby forming a polymerized resist); (3) using fluorinated hydrocarbons (e.g., CF4, C2F6), or a combination of nitric acid with sulfuric acid; and (4) removing polymerized resist by using a resist stripper solvent. Herein, reshaped layer 370 is referred to as arm 370A.

Action 495 includes removing a remaining sacrificial layer 330A. FIG. 12 depicts in cross section an example structure, switch 300, that may result from action 495. A suitable technique to remove remaining sacrificial layer 330A includes submerging structure depicted in FIG. 22 into an HF solution.

FIG. 23

Figure 23:
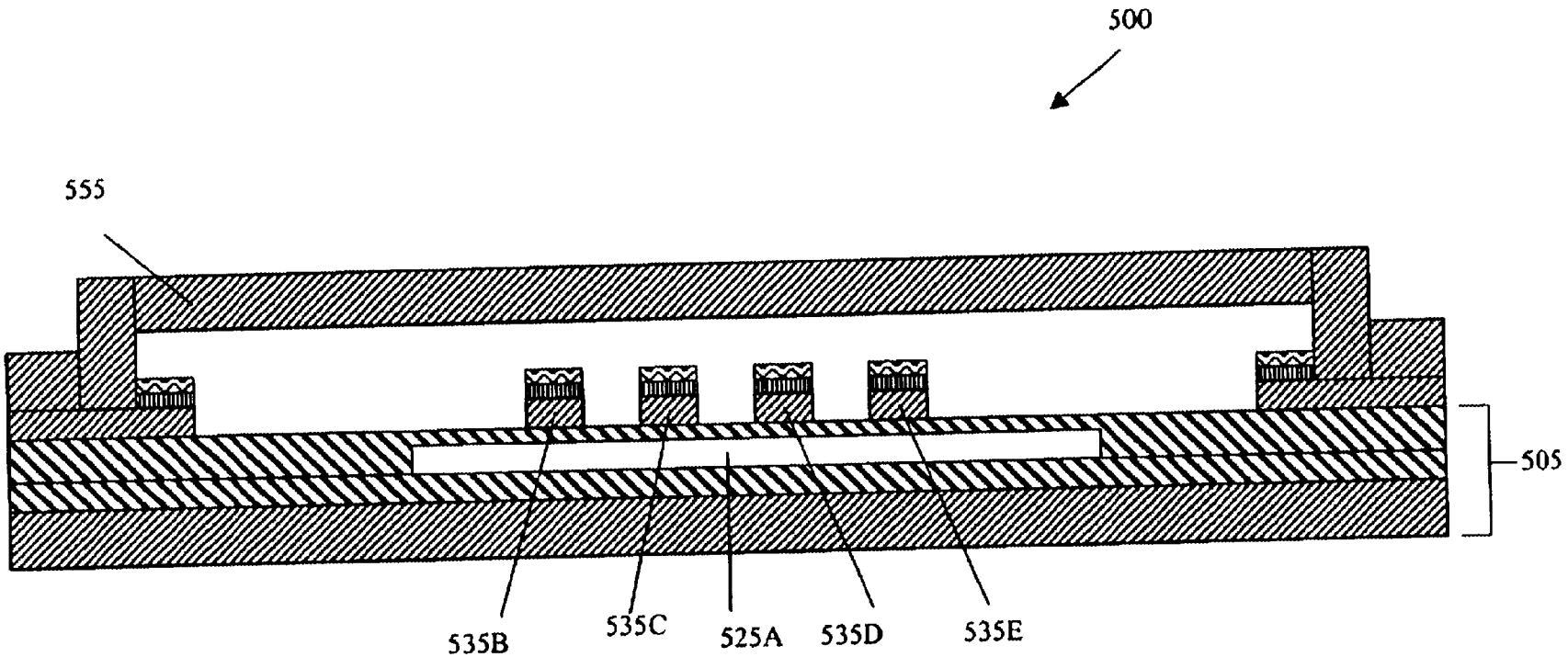
FIG. 23 depicts in cross section a switch, in accordance with an embodiment of the present invention.

FIG. 23 depicts in cross section a switch 500, in accordance with an embodiment of the present invention. Switch 500 may include base 505, actuation 525A, arm 555, contacts 535B to 535E. Contacts 535B to 535E may be attached to base 505. When an electric field is applied between actuation 525A and arm 555, arm 555 may lower towards contacts 535B to 535E and may be capable of establishing a conductive connection with contacts 535B to 535E. In accordance with an embodiment of the present invention, contacts 535B to 535E may include a durable coating layer that may protect contacts 535B to 535E from wear.

Figure 24:
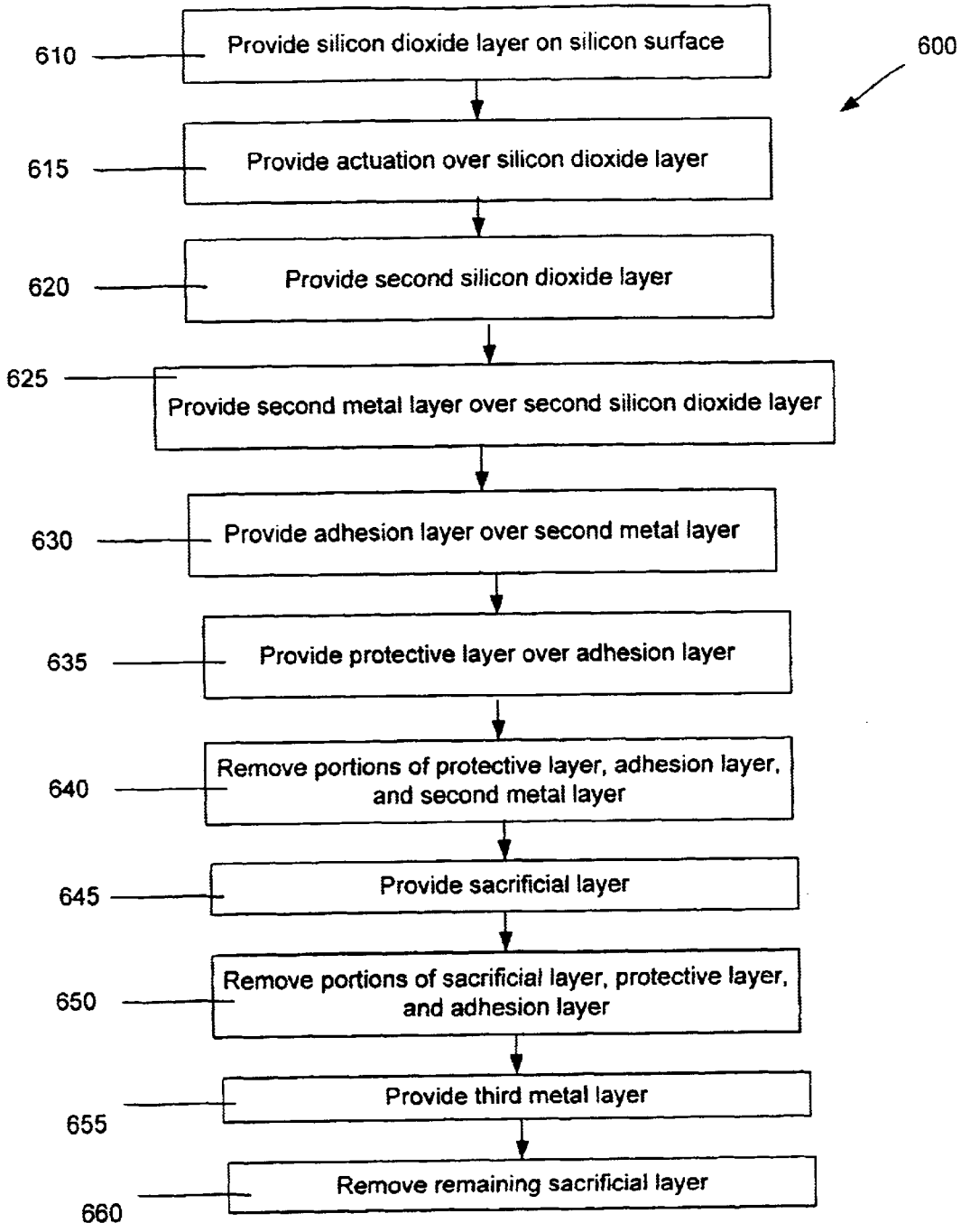
FIG. 24 depicts one possible process that may be used to construct the switch of FIG. 23, in accordance with an embodiment of the present invention.
Figure 25:
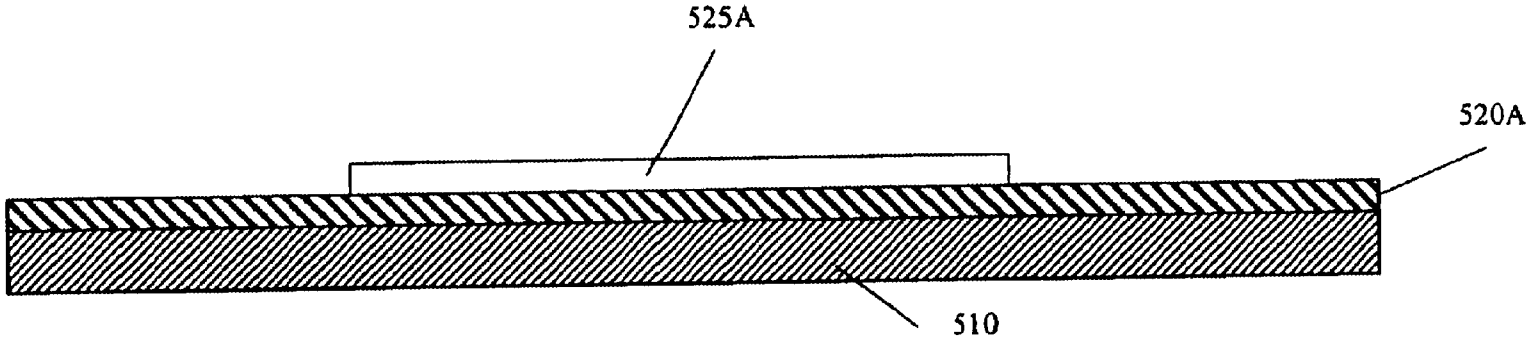
FIGS. 25 to 33 depict in cross section various stages of fabrication of the switch of FIG. 23, in accordance with an embodiment of the present invention.

In accordance with an embodiment of the present invention, FIG. 24 depicts one possible process that may be used to construct the switch 500 depicted in FIG. 23. Action 610 includes forming $SiO_2$ layer 520A on a silicon layer 510. A suitable implementation of silicon layer 510 is a silicon wafer. A suitable thickness of $SiO_2$ layer 520A is approximately 0.2 to 1 micron. Action 615 includes forming a metal layer 525 over $SiO_2$ layer 520A. A suitable thickness of metal layer 525 is approximately 0.2 to 1 micron. A suitable material of metal layer 525 includes gold and/or aluminum. A suitable technique to provide metal layer 525 includes (1) sputter deposition or physical vapor deposition and (2) etch to remove portions of metal layer 525 to form the actuation 525A. FIG. 25 depicts in cross section a structure that may result from actions 610 and 615.

Figure 26:
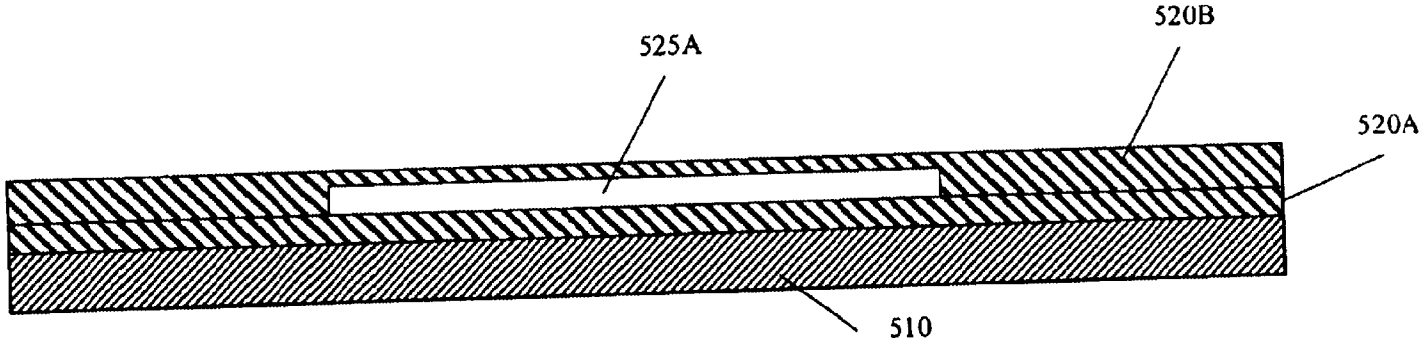

Action 620 includes forming a second $SiO_2$ layer 520B over the structure depicted in cross section in FIG. 25. A suitable thickness of the second $SiO_2$ layer 520B is approximately 2 to 4 microns over actuation 525A. FIG. 26 depicts in cross section a structure that may result from action 620. Herein, base 505 may refer to a combination of layers 510, 520A, and 520B as well as actuation 525A.

Figure 27:
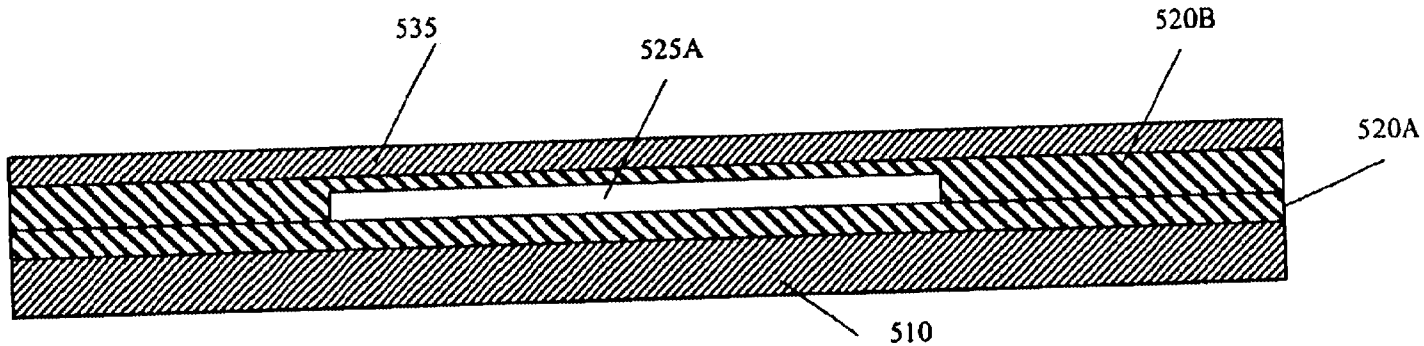

Action 625 includes providing second metal layer 535 over the structure shown in cross section in FIG. 26. FIG. 27 depicts in cross section a structure that may result from action 625. Suitable materials of second metal layer 535 include gold and/or aluminum. A suitable technique to provide second metal layer 535 includes sputter deposition or physical vapor deposition. Suitable thickness of second metal layer 535 is approximately ½ to 1 micron.

Figure 28:
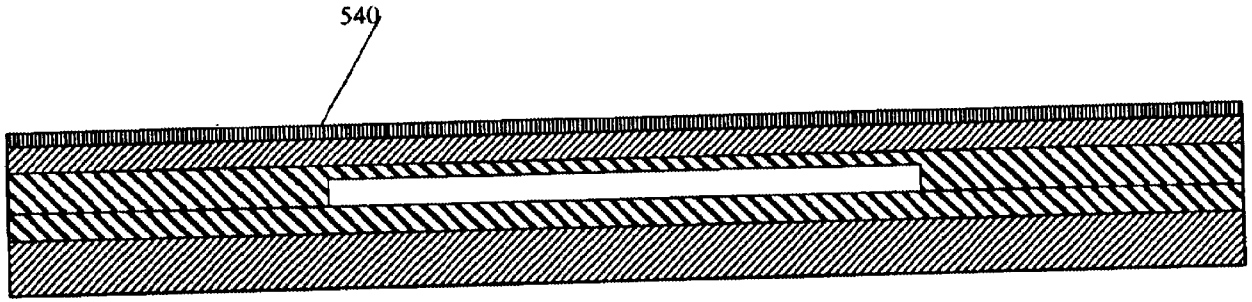

Action 630 includes providing adhesion layer 540 over second metal layer 535. FIG. 28 depicts in cross section a structure that may result from action 630. Suitable materials of layer 540 include titanium, molybdenum, and/or tungsten. A suitable technique to provide metal layer 540 includes sputter deposition or physical vapor deposition. A suitable thickness of layer 540 is approximately 0.1 micron.

Figure 29:
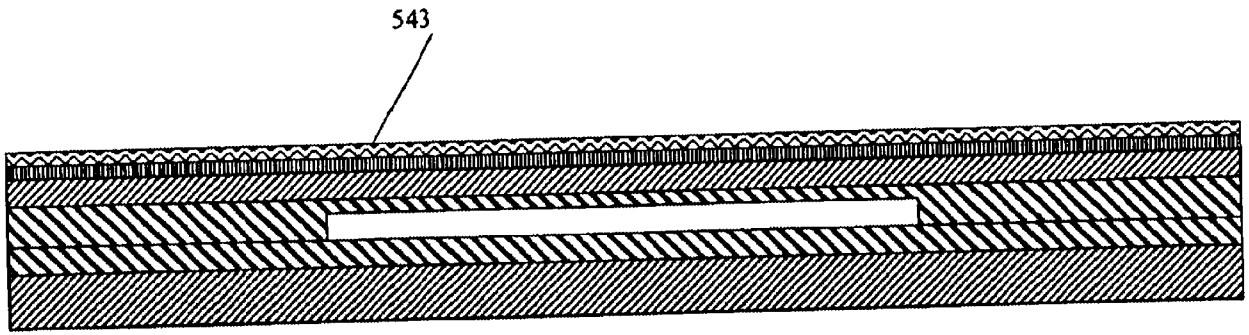

Action 635 includes providing protective layer 543 over layer 540. FIG. 29 depicts in cross section a structure that may result from action 635. Suitable materials of protective layer 543 include, but are not limited to, diamond, rhodium, ruthenium, and/or diamond-like carbon film. A suitable technique to provide protective layer 543 includes plasma enhanced chemical vapor deposition (CVD). A suitable thickness of layer 543 is approximately 100 to 500 angstroms.

Figure 30:
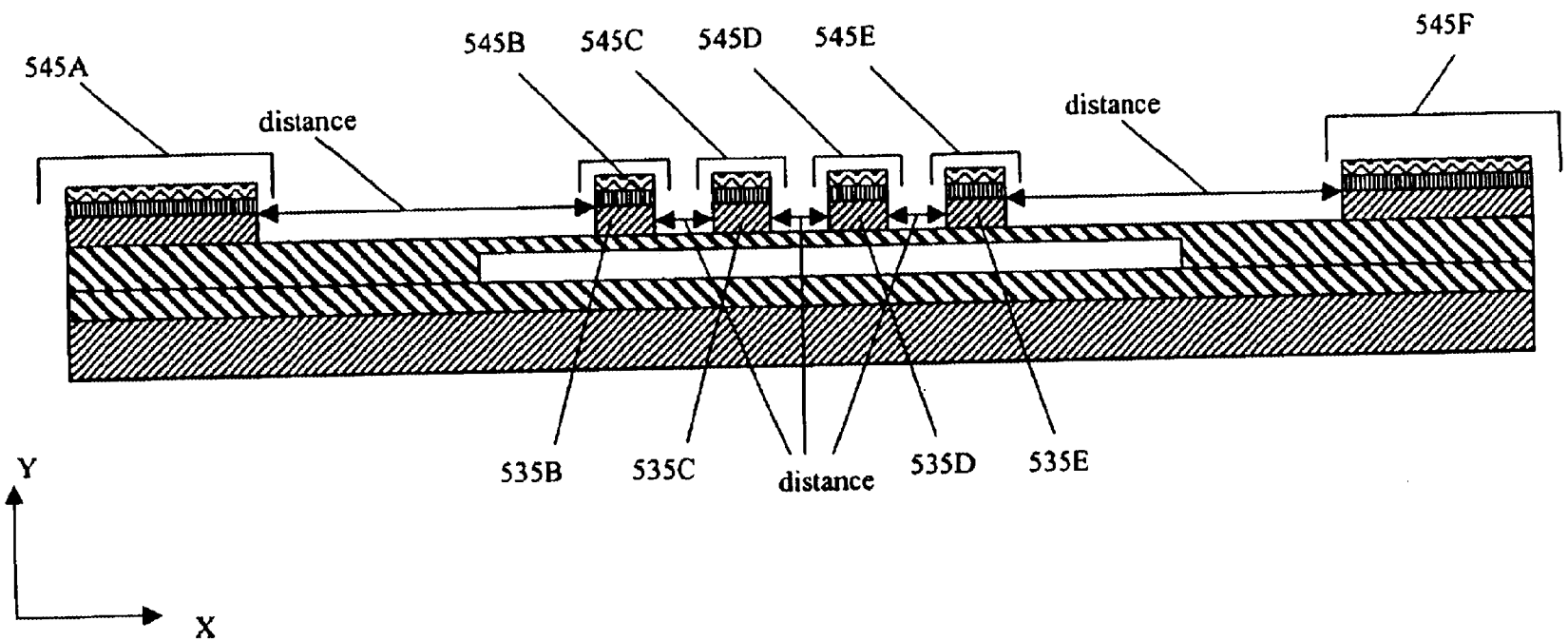

Action 640 includes removing portions of layers 535, 540, and 543 to form stacks 545A–545F. FIG. 30 depicts in cross section a structure that may result from action 640. Each of stacks 545A–545F includes portions of layers 535, 540, and 543. A suitable distance between stacks 545A and 545B (along the X axis) is approximately 20 to 80 microns. A suitable distance between stacks 545B and 545C (along the X axis) is approximately 2 to 10 microns. A suitable distance between stacks 545C and 545D (along the X axis) is approximately 2 to 10 microns. A suitable distance between stacks 545D and 545E (along the X axis) is approximately 2 to 10 microns. A suitable distance between stacks 545E and 545F (along the X axis) is approximately 20 to 80 microns. A suitable technique to remove portions of layers 535, 540, and 543 includes: (1) applying a mask to portions of the exposed surface of layer 543 that arm not to be removed; (2) photolithography to polymerize the mask (thereby forming a polymerized resist); (3) to remove layer 543, etch layer 543 by reactive ion etching or oxygen plasma; (4) to remove layers 535 and 540, using fluorinated hydrocarbons (e.g., $CF_4$ or $C_2F_6$), or a combination of nitric acid with sulfuric acid; and (5) removing polymerized resist by using a resist stripper solvent.

Figure 31:
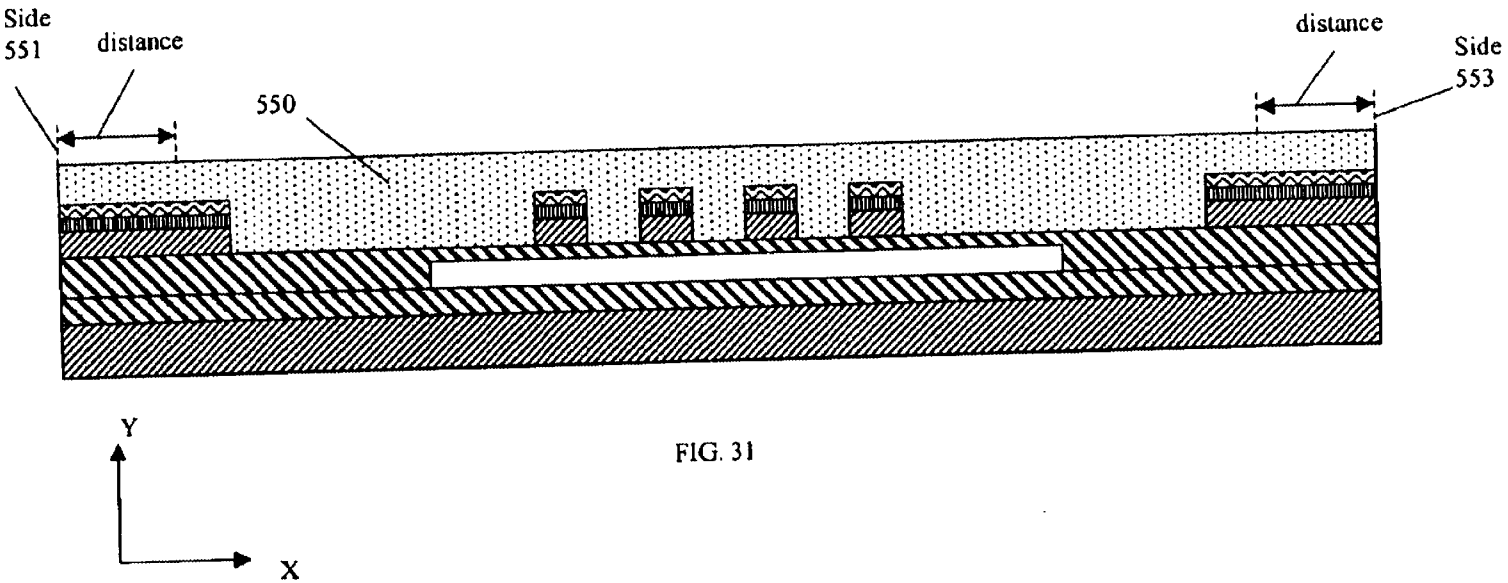

Action 645 includes providing sacrificial layer 550 over, for example, the structure depicted in cross section in FIG. 30. FIG. 31 depicts in cross section a structure that may result from action 645. Suitable materials of layer 550 include $SiO_2$, polymer, glass-based materials, and/or metals (e.g., copper). Suitable techniques to provide layer 550 include (1) sputtering, chemical vapor deposition (CVD), or physical vapor deposition followed by (2) polishing the surface of sacrificial layer 550 using e.g., chemical mechanical polish (CMP). A suitable thickness of layer 550 (along the Y axis) is approximately 1 micron over stacks 545A–545F.

Figure 32:
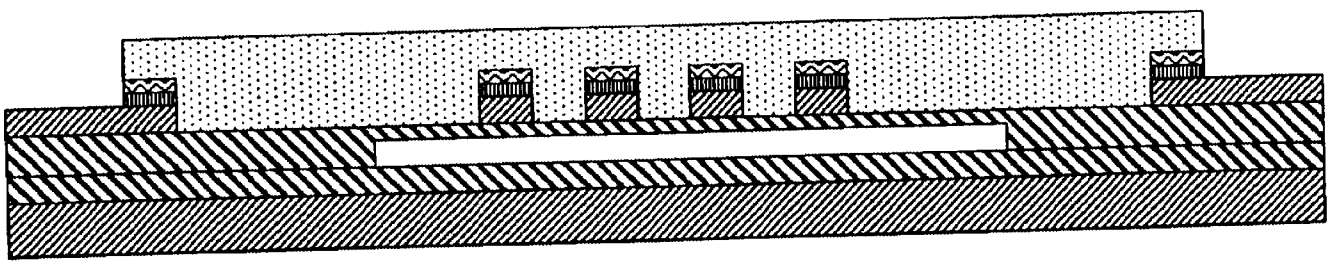

Action 650 includes removing a portion of layer 550 and portions of layers 540 and 543 of layers 545A and 545F from the structure depicted in cross section in FIG. 31. FIG. 32 depicts in cross section a structure that may result from action 650. From side 551 of the structure of FIG. 31, a suitable distance along the X axis to remove portion of layer 550 and layers 540 and 543 of layer 545A is approximately 10 to 30 microns. From side 553 of the structure depicted in cross section in FIG. 31, a suitable distance along the X axis to remove portion of layer 550 and layers 540 and 543 of layer 545F is approximately 10 to 30 microns. A suitable technique to implement action 650 includes: (1) applying a mask to portions of the exposed surface of layer 550 that are not to be removed; (2) photolithography to polymerize the mask (thereby forming a polymerized resist); (3) to remove layer 550, providing an HF solution; (4) to remove layer 543, use reactive ion etching or oxygen plasma; (5) to remove layer 540, providing fluorinated hydrocarbons (e.g., CF4, C2F6), or a combination of nitric acid with sulfuric acid; and (6) removing polymerized resist by using a resist stripper solvent.

Figure 33:
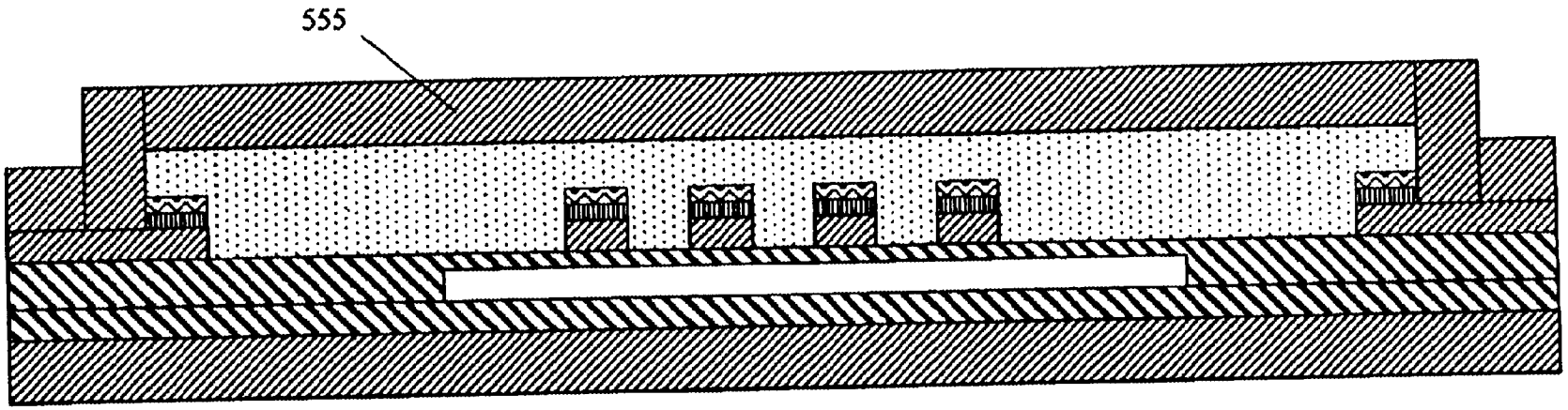

Action 655 includes providing a third metal conductive layer 555 over, for example, the structure depicted in cross section in FIG. 32. FIG. 33 depicts in cross section a structure that may result from action 655. A suitable material of third metal conductive layer 555 includes gold and/or aluminum. A suitable techniques to provide third metal conductive layer 555 include sputter deposition or physical vapor deposition. Suitable thickness of layer 555 is approximately 1 to 5 microns. Herein, layer 555 may be referred to as arm 555.

Action 660 includes removing the remaining sacrificial layer 550. FIG. 23 depicts in cross section a structure that may result from action 660. A suitable technique to remove remaining sacrificial layer 550 includes submerging the structure depicted in cross section in FIG. 33 into an HF solution.

FIG. 34

Figure 34:
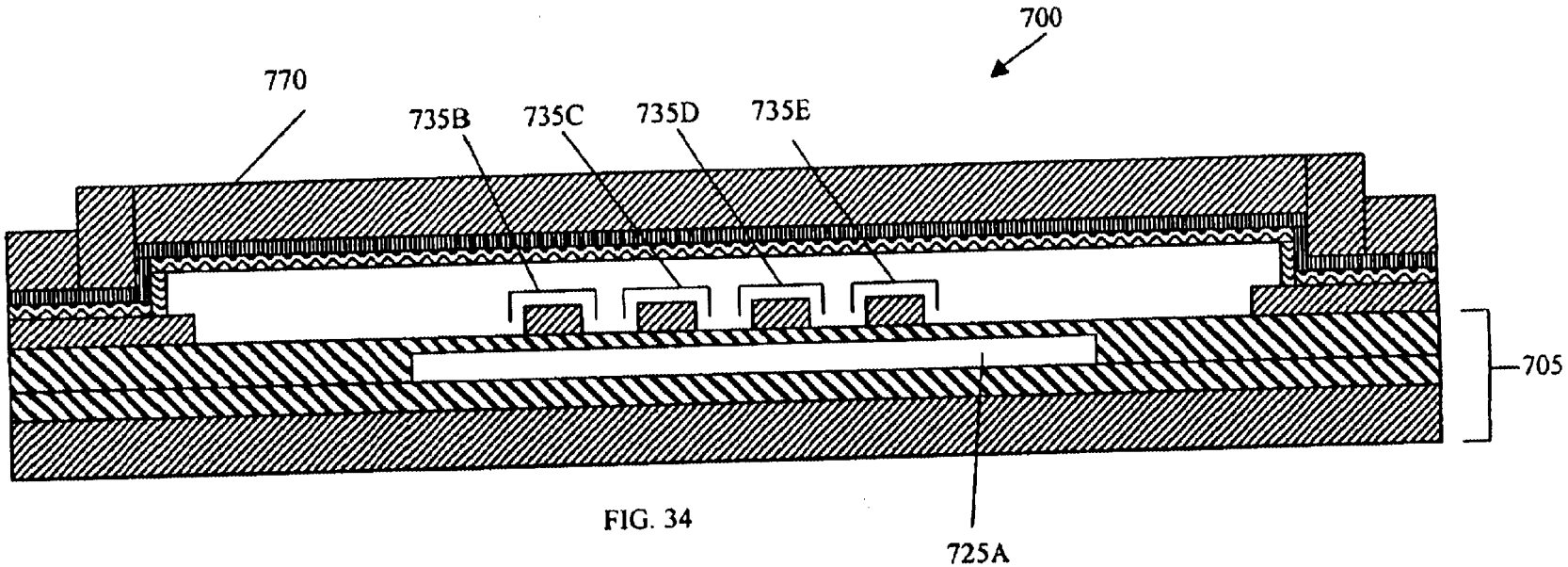
FIG. 34 depicts in cross section a switch, in accordance with an embodiment of the present invention.

FIG. 34 depicts in cross section a switch 700 in accordance with an embodiment of the present invention. Switch 700 may include base 705, actuation 725A, arm 770, contacts 735B to 735E. Contacts 735B to 735E may be attached to base 705. When an electric field is applied between actuation 725A and arm 770, arm 770 may lower towards contacts 735B to 735E and may be capable of establishing a conductive connection with contacts 735B to 735E. In accordance with an embodiment of the present invention, a surface of arm 770 which may contact contacts 735B to 735E may include a durable coating that may protect arm 770 from wear.

Figure 35:
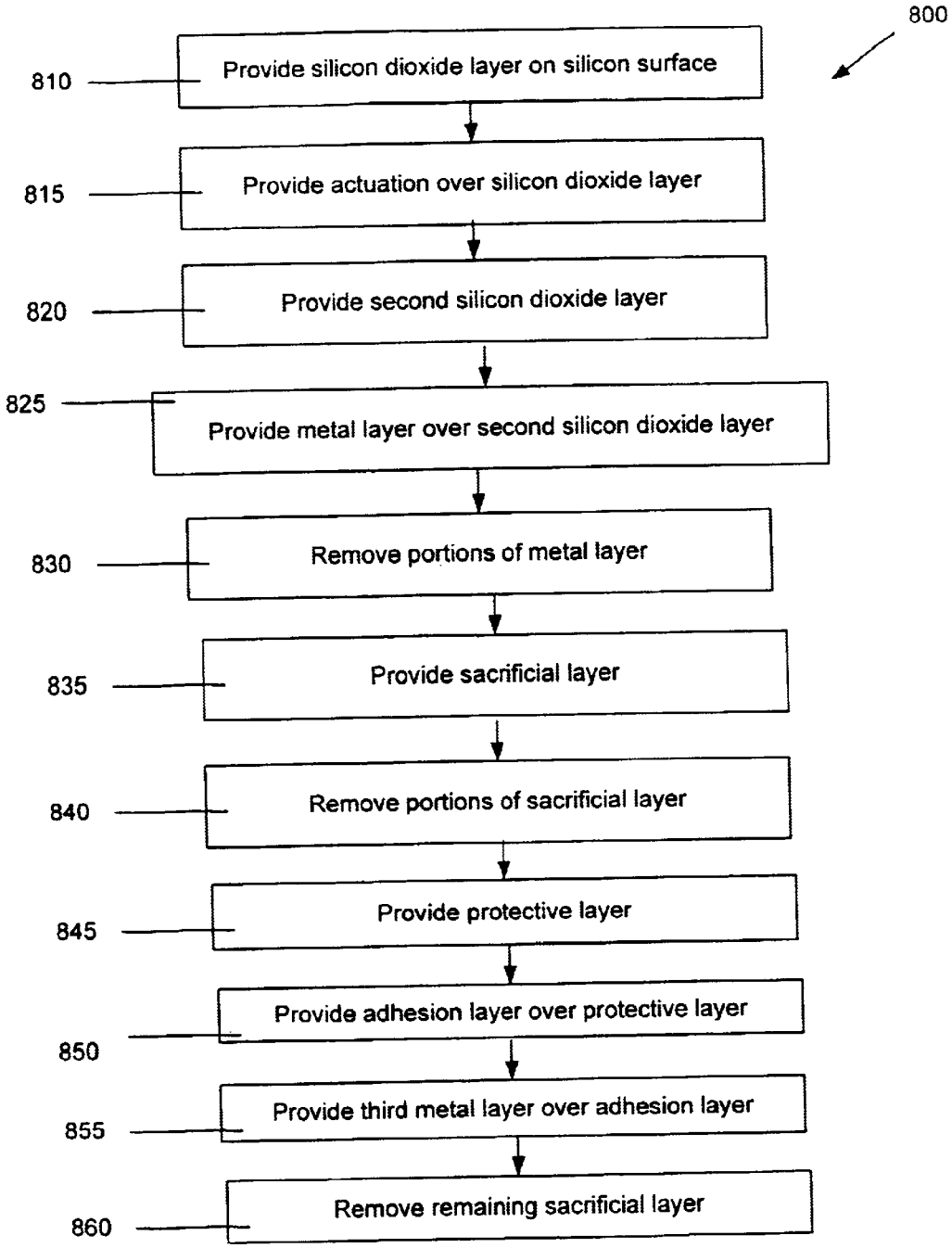
FIG. 35 depicts one possible process that may be used to construct the switch of FIG. 34, in accordance with an embodiment of the present invention.

In accordance with an embodiment of the present invention, FIG. 35 depicts one possible process that may be used to construct the switch 700 depicted in FIG. 34. Action 810 includes forming $SiO_2$ layer 720A over silicon layer 710. A suitable implementation of silicon layer 710 is a silicon wafer. A suitable thickness of $SiO_2$ layer 720A is approximately 0.2 to 1 micron.

Figure 36:
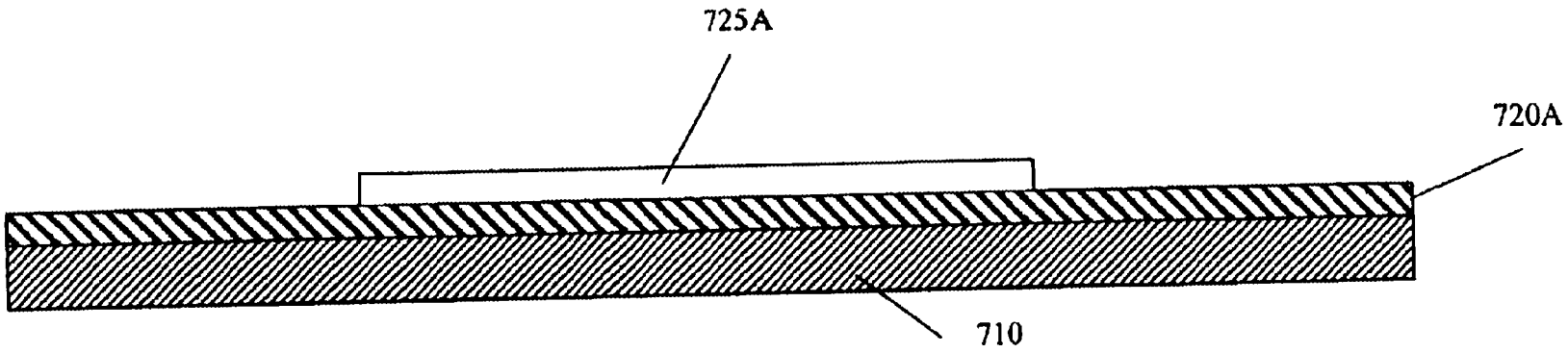
FIGS. 36 to 44 depict in cross section various stages of fabrication of the switch of FIG. 34, in accordance with an embodiment of the present invention.

Action 815 includes forming metal layer 725A over $SiO_2$ layer 720A. A suitable material of metal layer 725A includes gold and/or aluminum. A suitable technique to provide metal layer 725 includes (1) sputter deposition or physical vapor deposition of a metal layer and (2) etch to remove portions of metal layer 725 to form metal layer 725A. A suitable thickness of metal layer 725A is 0.2 to 1 micron. FIG. 36 depicts in cross section a structure that may result from actions 810 and 815. Herein, base 705 may refer to a combination of layers 710, 720A, and 720B as well as actuation 725A. Herein, actuation 725A may refer to metal layer 725A.

Figure 37:
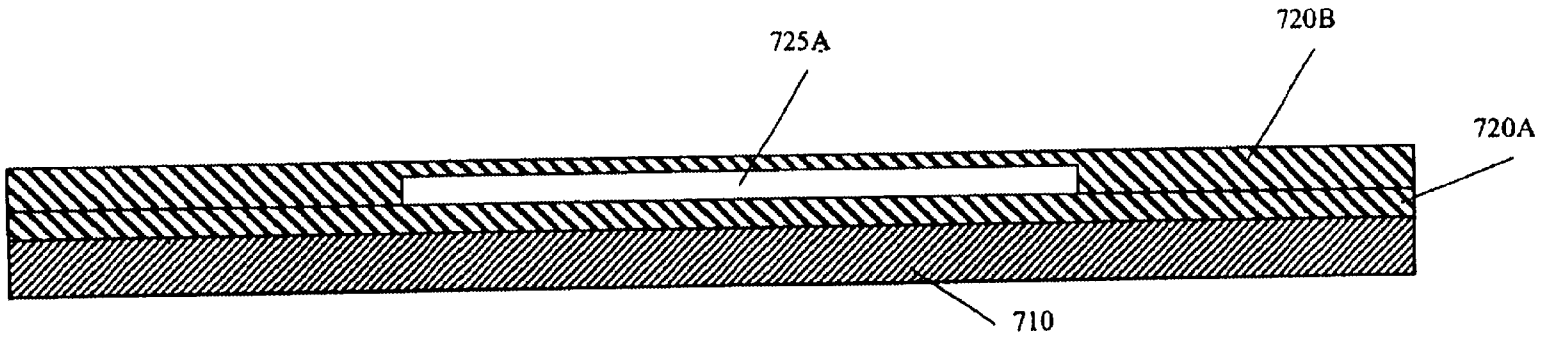

Action 820 includes forming $SiO_2$ layer 720B over structure depicted in cross section in FIG. 36. A suitable thickness of $SiO_2$ layer 720B is approximately 2 to 4 microns over actuation 725A. FIG. 37 depicts in cross section a structure that may result from action 820.

Figure 38:
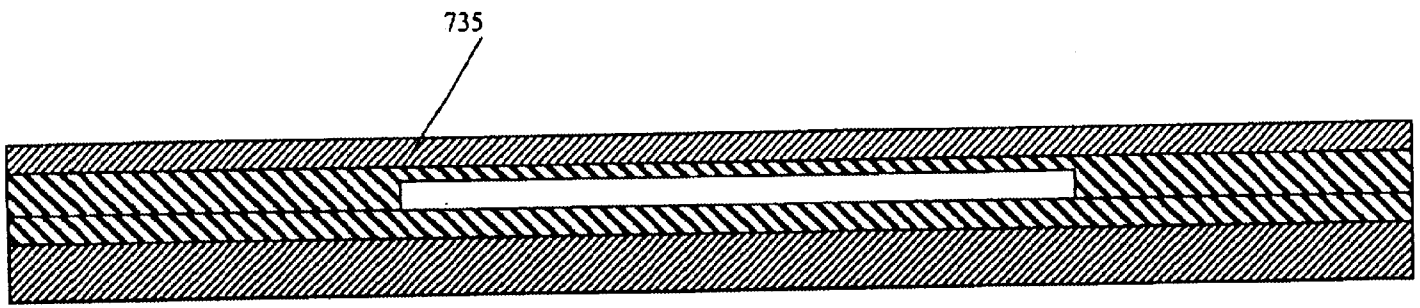
Figure 39:
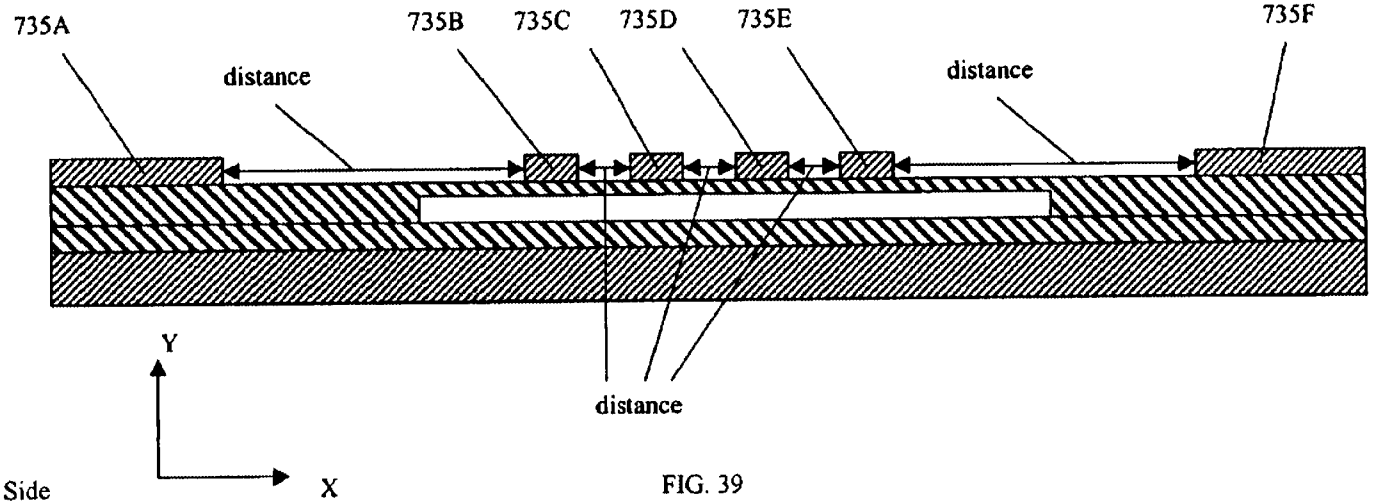

Action 825 includes providing metal layer 735 over the structure shown in cross section in FIG. 37. FIG. 38 depicts in cross section a structure that may result from action 825. Suitable materials of layer 735 include gold and or aluminum. A suitable technique to provide metal layer 735 includes sputter deposition or physical vapor deposition. A suitable thickness of layer 735 is approximately ½ to 1 micron Action 830 includes removing portions of layer 735 to form layers 735A–735F. FIG. 39 depicts in cross section a structure that may result from action 830. A suitable distance between layers 735A and 735B (along the X axis) is approximately 20 to 80 microns. A suitable distance between layers 735B and 735C (along the X axis) is approximately 2 to 10 microns. A suitable distance between layers 735C and 735D (along the X axis) is approximately 2 to 10 microns. A suitable distance between layers 735D and 735E (along the X axis) is approximately 2 to 10 microns. A suitable distance been layers 735E and 735F (along the X axis) is approximately 20 to 80 microns. A suitable technique to remove portions of layer 735 includes: (1) applying a mask to portions of the exposed surface of layer 735 that are not to be removed; (2) photolithography to polymerize the mask (thereby forming a polymerized resist); (3) using fluorinated hydrocarbons (e.g., $CF_4$ or $C_2F_6$), or a combination of nitric acid with sulfuric acid; and (4) removing polymerized resist by using a resist stripper solvent.

Figure 40:
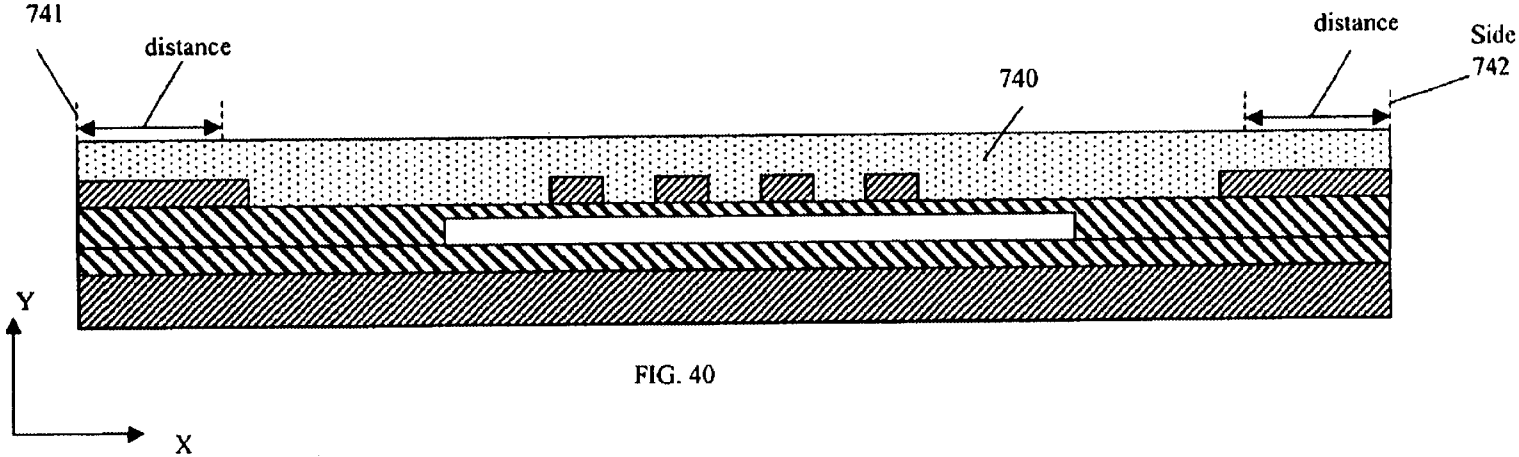

Action 835 includes providing a sacrificial layer 740 over the structure depicted in cross section in FIG. 39. FIG. 40 depicts in cross section a structure that may result from action 835. Suitable materials of layer 740 include $SiO_2$, polymer, glass-based materials, and/or metals (e.g., copper). Suitable techniques to provide layer 740 include (1) sputtering, chemical vapor deposition (CVD), or physical vapor deposition followed by (2) polishing the surface of sacrificial layer 740 using e.g., chemical mechanical polish (CMP). A suitable thickness of layer 740 (along the Y axis) over layers 735A–735F is approximately 0.5 to 2 microns.

Figure 41:
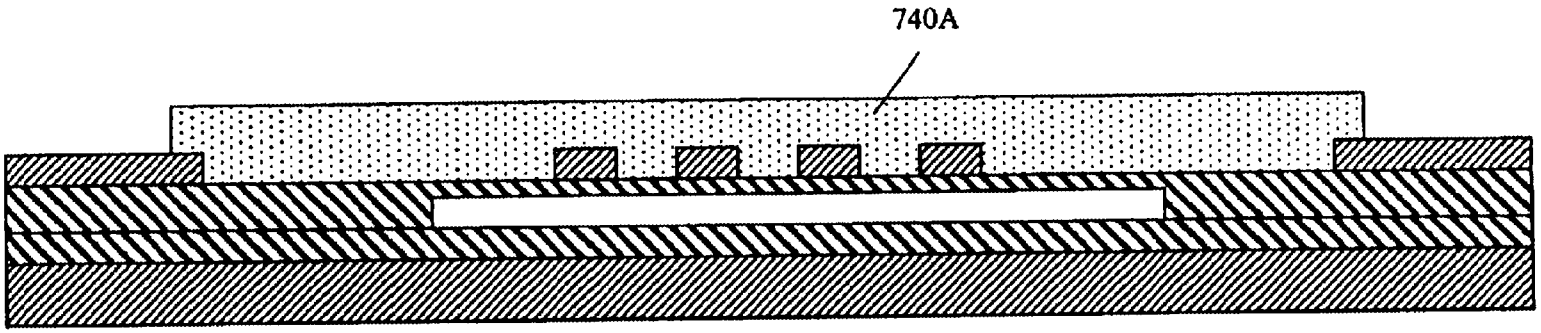

Action 840 includes removing portions of layer 740 from the structure depicted in cross section in FIG. 40. FIG. 41 depicts in cross section a structure that may result from action 840. From side 741 of structure of FIG. 40, a suitable distance along the X axis to remove a portion of layer 740 is approximately 10 to 30 microns. From side 742 of structure of FIG. 40, a suitable distance along the X axis to remove a portion of layer 740 is approximately 10 to 30 microns. A suitable technique to implement action 840 includes: (1) applying a mask to portions of the exposed surface of layer 740 that are not to be removed; (2) photolithography to polymerize the mask (thereby forming a polymerized resist); (3) to remove layer 740, providing an HF solution; and (4) removing polymerized resist by using a resist stripper solvent. Hereafter, re-shaped layer 740 is referred to as layer 740A.

Figure 42:
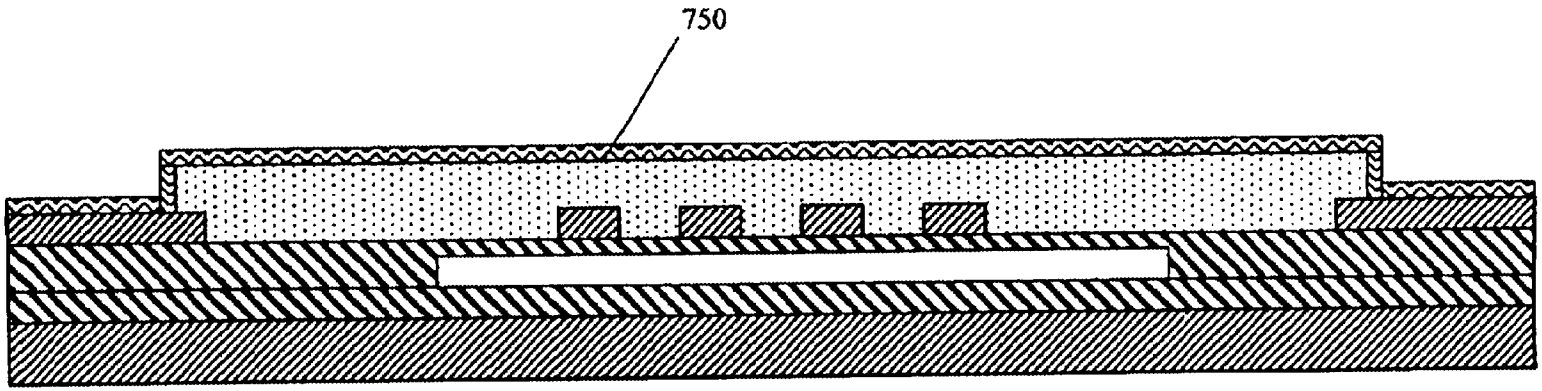
Figure 43:
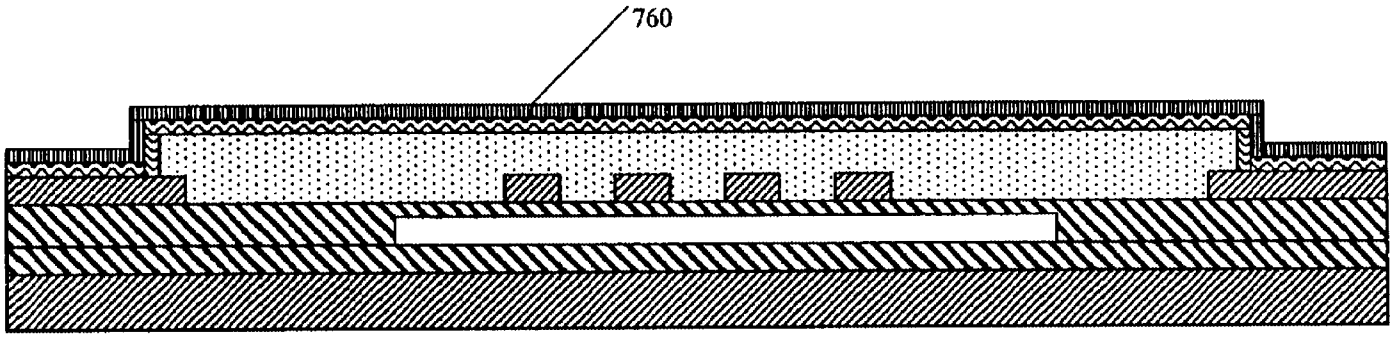

Action 845 includes providing protective layer 750 over the structure depicted in cross section in FIG. 41. FIG. 42 depicts in cross section a structure that may result from action 845. Suitable materials of protective layer 750 include, but are not limited to, diamond, rhodium, ruthenium, and/or diamond-like carbon film. A suitable technique to provide protective layer 750 includes plasma enhanced chemical vapor deposition (CVD). A suitable thickness of layer 750 is approximately 100 to 500 angstroms Action 850 includes providing adhesion layer 760 over the structure depicted in cross section in FIG. 42. FIG. 43 depicts in cross section a structure that may result from action 850. Suitable materials of layer 760 include titanium, molybdenum, and/or tungsten. A suitable technique to provide metal layer 760 includes sputter deposition or physical vapor deposition. Suitable thickness of layer 760 is approximately 0.1 micron.

Figure 44:
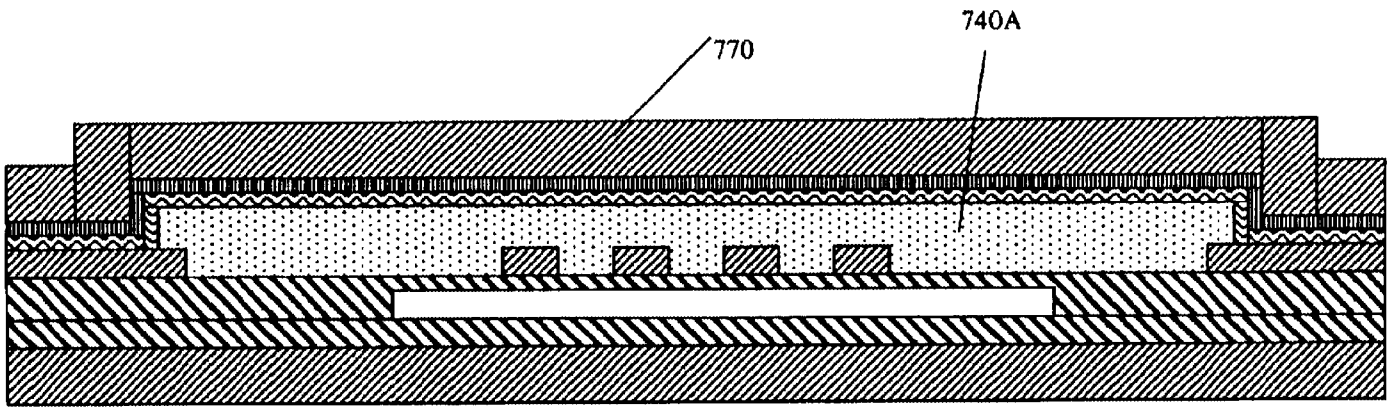

Action 855 includes providing third metal conductive layer 770 over the structure shown in cross section in FIG. 43. FIG. 44 depicts in cross section a structure that may result from action 855. A suitable material of metal conductive layer 770 includes gold and/or aluminum. Suitable techniques to provide layer 770 include sputter deposition or physical vapor deposition. A suitable thickness of layer 770 is approximately 1 to 5 microns.

Action 860 includes removing remaining sacrificial layer 740A. FIG. 34 depicts in cross section a structure that may result from action 860. A suitable technique to remove remaining sacrificial layer 740A includes submerging structure depicted in cross section in FIG. 44 into an HF solution.

MODIFICATIONS

The drawings and the forgoing description gave examples of the present invention. The scope of the present invention, however, is by no means limited by these specific examples. Numerous variations, whether explicitly given in the specification or not, such as differences in structure, dimension, and use of material, are possible. Process actions may be combined and performed at the same time. The scope of the invention is at least as broad as given by the following claims.

What is claimed is:

1. A method comprising:

forming a conductive contact region over a base structure;

forming an actuation region over the base structure;

forming a protective coating over the contact region;

forming an arm structure over the base structure; and forming a dimple region on the arm structure opposite the coated contact region.

2. The method of claim 1, wherein the coating comprises diamond.

3. The method of claim 1, wherein the coating comprises rhodium.

4. The method of claim 1, wherein the coating comprises ruthenium.

5. The method of claim 1, wherein the coating comprises a diamond-like carbon film.

6. The method of claim 1, further comprising forming an adhesion layer between the coating and the contact region.

7. A method comprising:

forming a contact region over a base structure;

forming an actuation region over the base structure;

forming an arm structure over the base structure;

forming a conductive dimple region on the arm structure opposite the coated contact region; and forming a protective coating over the contact region.

8. The method of claim 7, wherein the coating comprises diamond.

9. The method of claim 7, wherein the coating comprises rhodium.

10. The method of claim 7, wherein the coating comprises ruthenium.

11. The method of claim 7, wherein the coating comprises a diamond-like carbon film.

12. The method of claim 7, further comprising forming an adhesion layer between the coating and the dimple region.

13. A method comprising:

forming a metal actuation region within a base structure;

forming at least one metal contact region on the base structure;

forming a protective coating over the at least one metal contact region; and forming an arm structure over the base structure and opposite the at least one metal contact region.

14. The method of claim 13, wherein the coating comprises diamond.

15. The method of claim 13, wherein the coating comprises rhodium.

16. The method of claim 13, wherein the coating comprises ruthenium.

17. The method of claim 13, wherein the coating comprises a diamond-like carbon film.

18. The method of claim 13, further comprising forming an adhesion layer between the coating and the at least one metal contact region.

19. A method comprising:

forming a metal actuation region within a base structure;

forming at least one metal contact region on the base structure;

forming an arm structure over the base structure and opposite the at least one metal contact region; and forming a protective coating on at least a portion of a side of the arm structure opposite the at least one metal contact region.

20. The method of claim 19, wherein the coating comprises diamond.

21. The method of claim 19, wherein the coating comprises rhodium.

22. The method of claim 19, wherein the coating comprises ruthenium.

23. The method of claim 19, wherein the coating comprises a diamond-like carbon film.

24. The method of claim 19, further comprising forming an adhesion layer between the coating and the arm structure.

25. A method comprising:

applying an electric field between a fist and second surfaces to bring a the first surface into contact with the second surface, wherein the first surface is coated with a protective coating.

26. The method of claim 25, wherein the coating comprises diamond.

27. The method of claim 25, wherein the coating comprises rhodium.

28. The method of claim 25, wherein the coating comprises ruthenium.

29. The method of claim 25, wherein the coating comprises a diamond-like carbon film.

30. The method of claim 1, further comprising forming a second coating over the actuation region.

31. The apparatus of claim 7, further comprising forming a second coating over the actuation region.

* * * * *

UNITED STATES PATENT AND TRADEMARK OFFICE

CERTIFICATE OF CORRECTION

PATENT NO. : 6,706,981 B1 Page 1 of 1
DATED : March 16, 2004
INVENTOR(S) : Ma et al.

It is certified that error appears in the above-identified patent and that said Letters Patent is hereby corrected as shown below:

Column 10,
Line 46, delete “fist”, insert -- first --.

Signed and Sealed this

Second Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,706,981 B1 
DATED : March 16, 2004
INVENTOR(S) : Ma et al.

It is certified that error appears in the above-identified patent and that said Letters Patent is hereby corrected as shown below:

Column 2,
Line 55, delete "cop" and insert -- copper --.
Line 64, delete "laws" and insert -- layers --.

Column 6,
Line 48, delete "arm" and insert -- are --.

Column 8,
Line 23, delete "been" and insert -- between --.

Column 10,
Line 60, delete "apparatus" and insert -- method --.

Signed and Sealed this

Seventeenth Day of May, 2005

JON W. DUDAS
*Director of the United States Patent and Trademark Office*